US012480317B2

(12) United States Patent
Evans

(10) Patent No.: US 12,480,317 B2
(45) Date of Patent: Nov. 25, 2025

(54) SIDEWALK SHED

(71) Applicant: Universal Builders Supply, LLC, New Rochelle, NY (US)

(72) Inventor: Christopher Evans, New Rochelle, NY (US)

(73) Assignee: Universal Builders Supply, LLC, New Rochelle, NY (US)

( * ) Notice: Subject to any disclaimer, the term of this patent is extended or adjusted under 35 U.S.C. 154(b) by 946 days.

(21) Appl. No.: 17/680,663

(22) Filed: Feb. 25, 2022

(65) Prior Publication Data

US 2022/0282500 A1 Sep. 8, 2022

Related U.S. Application Data

(60) Provisional application No. 63/156,490, filed on Mar. 4, 2021.

(51) Int. Cl.
*E04G 1/04* (2006.01)
*E04G 1/15* (2006.01)
*E04G 5/14* (2006.01)

(52) U.S. Cl.
CPC ..... *E04G 1/04* (2013.01); *E04G 1/15* (2013.01); *E04G 5/14* (2013.01)

(58) Field of Classification Search
CPC .... E04G 1/04; E04G 1/15; E04G 1/20; E04G 5/14; E04G 21/32; E04G 21/3209
See application file for complete search history.

(56) References Cited

U.S. PATENT DOCUMENTS 2,164,519 A * 7/1939 Hayner ..... E04G 1/20 182/229
D116,188 S 8/1939 Frost
3,016,105 A * 1/1962 House ..... E04G 1/22 182/115
3,610,368 A * 10/1971 Johnson ..... E04G 1/20 182/146
4,641,728 A * 2/1987 McCabe ..... E04G 1/20 182/132
4,972,924 A * 11/1990 Nielsen ..... E04G 21/32 24/514
5,029,421 A * 7/1991 Nielsen ..... E04G 21/32 52/126.5
5,884,725 A * 3/1999 Reyland ..... E04G 1/20 182/136
6,148,580 A 11/2000 Weir
(Continued)

FOREIGN PATENT DOCUMENTS

JP D1625260 2/2019
KR 300541405-0000 10/2009
KR 301040533-0000 1/2020

*Primary Examiner* — Johnnie A. Shablack
(74) *Attorney, Agent, or Firm* — Hoffmann & Baron, LLP

(57) ABSTRACT

A sidewalk shed for placement proximal to a building includes: a plurality of canopy support arrangements including base members securable to grade; a beam support structure securably disposed to upper portions of the plurality of the canopy support arrangements; and a canopy structure securably disposed to the beam support structure. The plurality of canopy support arrangements includes dual canopy support arrangements and single support arrangements. The canopy structure includes a parapet wall and a decking.

20 Claims, 26 Drawing Sheets

(56) References Cited

U.S. PATENT DOCUMENTS

| | | | | |
|---|---|---|---|---|
| 6,557,666 | B1 * | 5/2003 | Drouin | E04G 21/32 182/178.1 |
| D484,617 | S | 12/2003 | Micheals | |
| D502,271 | S | 2/2005 | Stensrud | |
| D561,351 | S | 2/2008 | Wyse | |
| D663,438 | S | 7/2012 | Cortes et al. | |
| D675,343 | S | 1/2013 | Davis et al. | |
| D675,344 | S | 1/2013 | Davis et al. | |
| D686,755 | S | 7/2013 | Ahlander et al. | |
| 8,636,266 | B2 | 1/2014 | Gill | |
| 8,752,296 | B2 | 6/2014 | Samons et al. | |
| D789,552 | S | 6/2017 | Scorsone et al. | |
| D863,597 | S | 10/2019 | Li et al. | |
| 10,731,362 | B2 * | 8/2020 | Rogers | E04G 7/14 |
| D958,410 | S | 7/2022 | Barnard | |
| D972,171 | S | 12/2022 | Barnard | |
| D1,039,714 | S * | 8/2024 | Evans | D25/66 |
| D1,040,371 | S * | 8/2024 | Evans | D25/66 |
| 2004/0200668 | A1 * | 10/2004 | Duplessis | E04G 5/10 182/178.1 |
| 2005/0284693 | A1 | 12/2005 | Rhodes | |
| 2008/0053017 | A1 | 3/2008 | Hockemeyer et al. | |
| 2009/0020363 | A1 * | 1/2009 | Ingalls | E04G 5/001 182/113 |
| 2011/0204307 | A1 | 8/2011 | Bowman | |
| 2011/0278094 | A1 * | 11/2011 | Gute | E04G 1/14 182/223 |
| 2012/0255256 | A1 * | 10/2012 | Montalto | E04G 21/3209 52/650.3 |
| 2013/0043095 | A1 * | 2/2013 | Thacker | E04G 5/14 182/186.7 |
| 2013/0118834 | A1 | 5/2013 | Engels | |
| 2017/0114555 | A1 | 4/2017 | Henneberry et al. | |
| 2017/0159304 | A1 | 6/2017 | Young | |
| 2019/0186157 | A1 | 6/2019 | Melic et al. | |
| 2019/0186158 | A1 | 6/2019 | Melic et al. | |
| 2021/0245849 | A1 | 8/2021 | Zierke | |
| 2022/0170278 | A1 * | 6/2022 | Barnard | E04G 1/22 |
| 2022/0282500 | A1 * | 9/2022 | Evans | E04G 5/14 |
| 2023/0323680 | A1 * | 10/2023 | Libani | E04G 1/04 182/222 |

* cited by examiner

SIDEWALK SHED

CROSS-REFERENCE TO RELATED APPLICATIONS

This application claims the benefit of U.S. Provisional Application No. 63/156,490, filed Mar. 4, 2021, the contents of which is incorporated by reference herein.

FIELD OF THE INVENTION

The present invention is related to a sidewalk shed for placement about a face or a portion of a building for providing pedestrian and/or public protection.

BACKGROUND OF THE INVENTION

Buildings undergoing maintenance or in need of maintenance may present a safety hazard to the public. For example, maintenance materials and/or building debris may fall presenting danger to the public.

Some examples of safety platforms and safety fencing have been proposed in the prior art as described below.

U.S. Pat. No. 8,636,266 B2 is directed to a fence for safety barricading system which may be disposed about a building during construction. The fence includes clip and pin securement assemblies for securing a mesh screen to a portion of a safety scaffolding, such as a tubular member, for example a hand rail of the safety barricading system.

US 2019/0186157 A1 is directed to a modular safety fence which may be used during construction. The fence includes a mesh panel and a plurality of rails for securing the fence. The safety fence is secured to a concrete floor during construction by various anchor assemblies.

US 2019/0186158 A1 is directed to a safety fence which extends between a floor and a ceiling of a building via telescoping posts. The fence is used during construction to provide safety.

U.S. Pat. No. D675,343 S shows an ornamental design of the support structure having vertical pipe supports and angled pipe supports for supporting a frame for a platform.

U.S. Pat. No. D663,438 S shows an ornamental design for an umbrella scaffolding structure having inwardly arched members on support posts and upper fan-like panel.

US 2005/0284693 A1 is directed to a fall-protection system configured to couple a person to a frame of the system. The fall-protection system includes a first bracket-pole assembly, a second bracket-pole assembly, a cable, and a lanyard.

US 2017/0114555 A1 is directed to a scaffolding having an arched structure. The arched structure is clamped to vertical and horizontal scaffolding supports.

U.S. Pat. No. 8,752,296 B2 is directed to a scaffold assembly for installation to an open stud wall by a single individual. The assembly includes a horizontal walkway supporting member and vertical rail support members. Rotatable members are used to secure the assembly to the studs.

US 2013/0118834 A1 describes a collapsible access platform for unloading flatbed trucks. The platform is elevated and accessible via ladders.

US 2017/0159304 A1 discloses a scaffolding assembly with an overhead hoarding assembly which includes pedestrian canopy support. The pedestrian canopy support is slanted to divert falling objects away from an underlying pedestrian area, such as a sidewalk.

US 2011/0204307 A1 is directed to couplers for securing members, such as vertical posts and a horizontal platform, of a sidewalk shed system. The system includes a fencing system having a plurality of channels.

U.S. Pat. No. D484,617 S merely depicts scaffold support brackets. Such brackets are useful for supporting horizontal members of a scaffold.

U.S. Pat. No. 6,148,580 discloses a safety frame having at least four legs, a pair of spaced apart beams, each connected to two of the legs, and at least one cross-beam extending between and secured to the pair of spaced apart beams. At least one person is slidably disposed on the at least one cross-beam via a tethering device, such as a lanyard, secured to the person.

U.S. Pat. No. D561,351 S merely depicts a scaffold frame section with integral guardrail post.

None of these references fully address pedestrian or public protection for buildings in need of maintenance during maintenance procedures on buildings.

Thus, there is a need for improved pedestrian and/or public protection in areas proximal to a building undergoing maintenance or in need of maintenance.

SUMMARY OF THE INVENTION

The present invention provides a sidewalk shed to offer pedestrian and/or public protection at areas about, near or proximal to a building.

In one aspect of the present invention, a sidewalk shed for placement proximal to a building may include: a plurality of canopy support arrangements comprising base members securable to grade; a beam support structure securably disposed to upper portions of the plurality of the canopy support arrangements; and a canopy structure securably disposed to the beam support structure. The plurality of canopy support arrangements may include dual canopy support arrangements and single support arrangements. The canopy structure may include a parapet wall and a decking.

The sidewalk shed may be disposed proximal to a face or portion of the building.

The beam support structure may include cross beams disposed along a width of the sidewalk shed and longitudinal beams disposed along a length of the sidewalk shed.

The single support arrangements may include a base member and an upper support member. A lower portion of the upper support member may be securably disposed to the base member. An upper portion of the upper support member may be securably disposed to the beam support structure. Additionally, the single support members may optionally include a lower support member where a lower portion of the lower support member is securably disposed to the base member and the lower portion of the upper support member is securably disposed to an upper portion of the lower support member.

The dual canopy support arrangements may include a base member; a lower support member; and at least two upper support members. A lower portion of the lower support member may be securably disposed to the base member. An upper portion of the lower support member may be securably disposed to the at least two upper support members. The upper portions of the at least two upper support members may be securably disposed to the beam structure.

The canopy structure may include a decking securably disposed to the beam structure; and a parapet wall extending upward from at least one side of the decking. The decking may include a plurality of decking panels. The decking panels may be a substantially transparent material. The parapet wall may include a perforated sheet.

These and other features and advantages of the present invention will become apparent from the following detailed description of illustrative embodiments thereof, which is to be read in connection with the accompanying drawings. Corresponding reference element numbers or characters indicate corresponding parts throughout the several views of the drawings.

DETAILED DESCRIPTION OF THE INVENTION

Figure 1A:
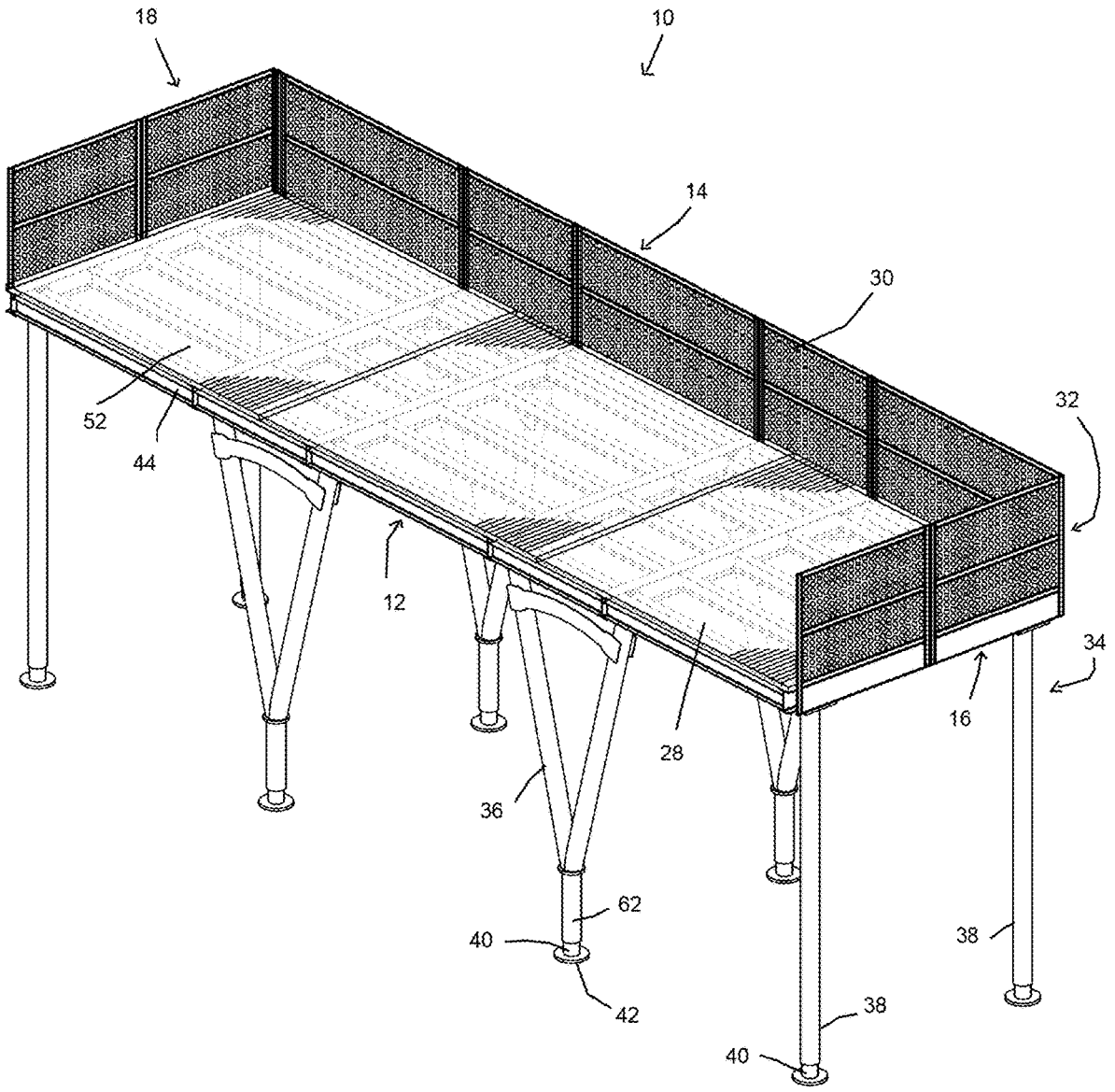
FIG. 1A is a top perspective view of the sidewalk shed of the present invention having transparent or translucent decking.
Figure 5:
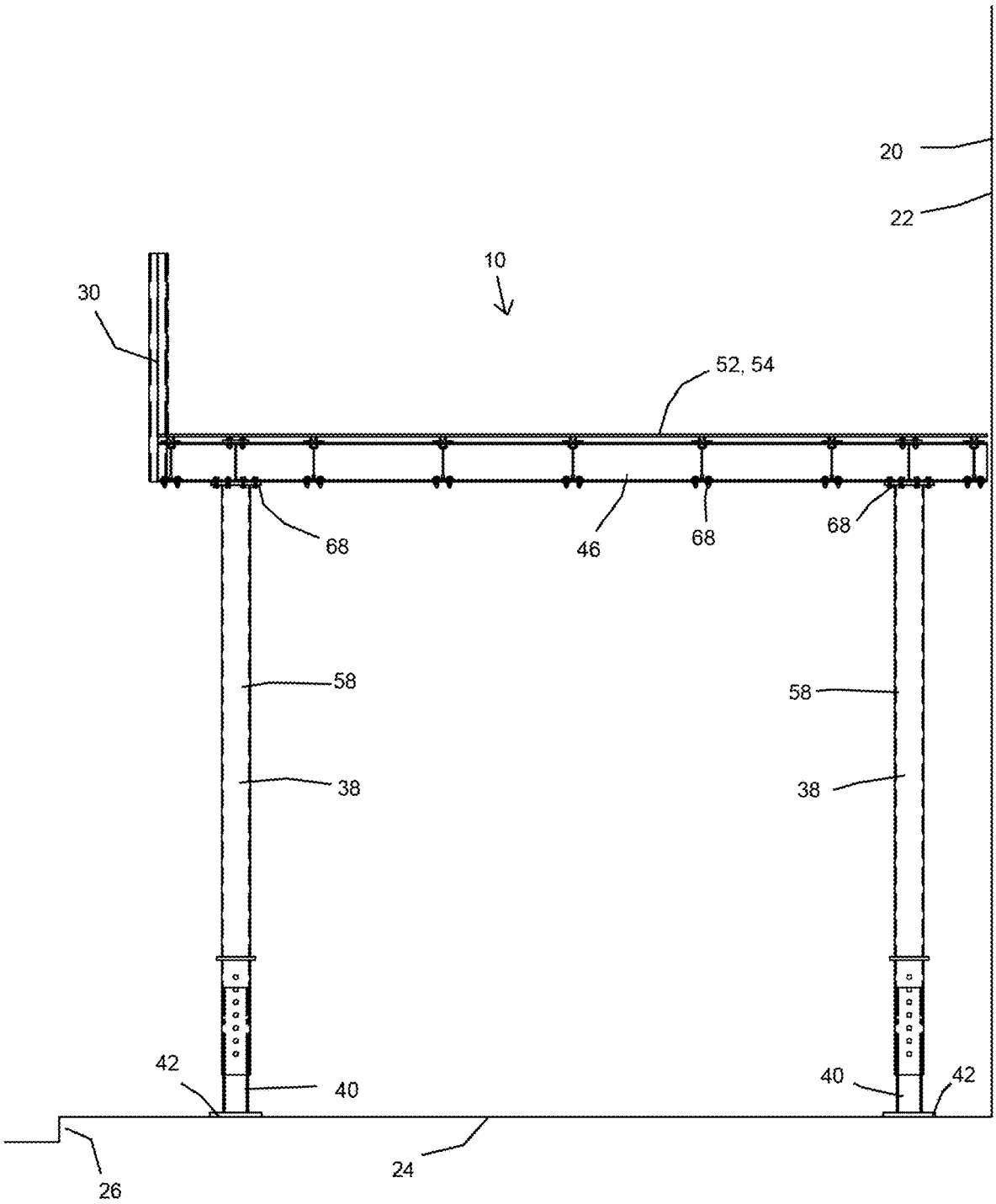
FIG. 5 is a side elevational view of a portion of the sidewalk shed of the present invention being disposed proximal to a schematically depicted building.
Figure 11:
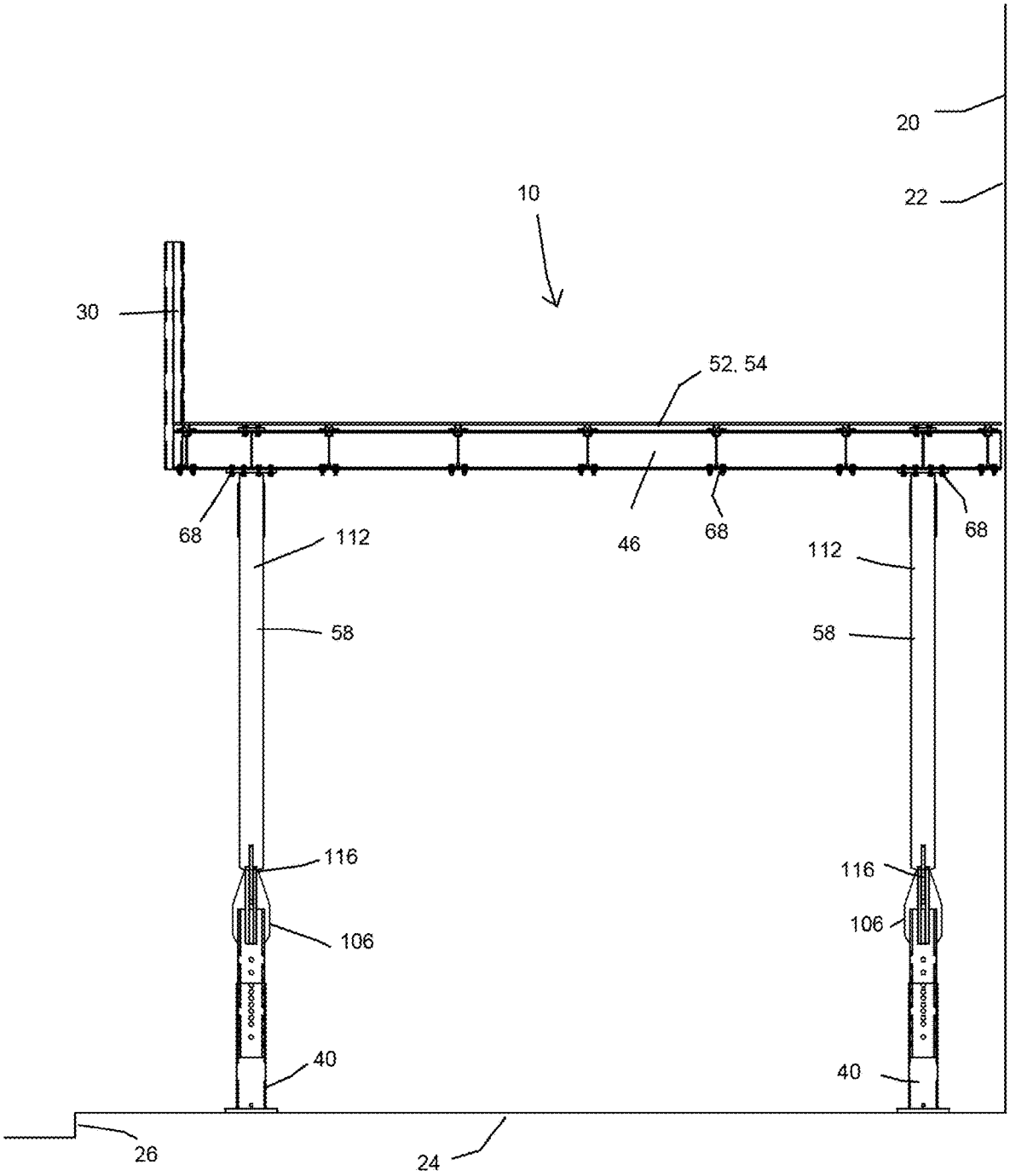
FIG. 11 is a side elevational view of a portion of the sidewalk shed of FIG. 10 being disposed proximal to a schematically depicted building.

FIG. 1A is a top perspective view of the sidewalk shed 10 of the present invention. The sidewalk shed 10 includes a front portion 12, a rear portion 14, a right side portion 16 and a left side portion 18. The front portion 12 of the sidewalk shed 10 of the present invention may be disposed along a face or portion of a building to serve as a protective canopy along the building, for example along a sidewalk or other access way along a building. Although the sidewalk shed 10 may be depicted as being disposed along the front of a building as shown in FIGS. 5 and 11, the present invention is not so limited. The sidewalk shed 10 may be disposed about or along any face or faces, for example front, side and rear faces, of a building or buildings and/or portions thereof. The sidewalk shed may be useful for providing pedestrian protection along a face of a building undergoing maintenance or construction or along a face of a building in need of maintenance.

The sidewalk shed 10 includes, among other items, a decking 28 and a parapet wall 30 for protection of pedestrian areas there below. The parapet wall 30 and decking 28, along with associated components, may be known as an overhead canopy arrangement 32. The decking panels 52 of the decking 28 are depicted in FIG. 1A as being substantially transparent panels or as being translucent panels. The present invention, however, is not limited to the use of transparent panels, and other materials and constructions of material may suitably be used.

As described below, the sidewalk shed 10 further includes an overhead canopy support arrangement 34. The overhead canopy support arrangement 34 may include, among other things, a beam support structure 44 and dual and/or single leg support arrangements 36, 38.

Figure 1B:
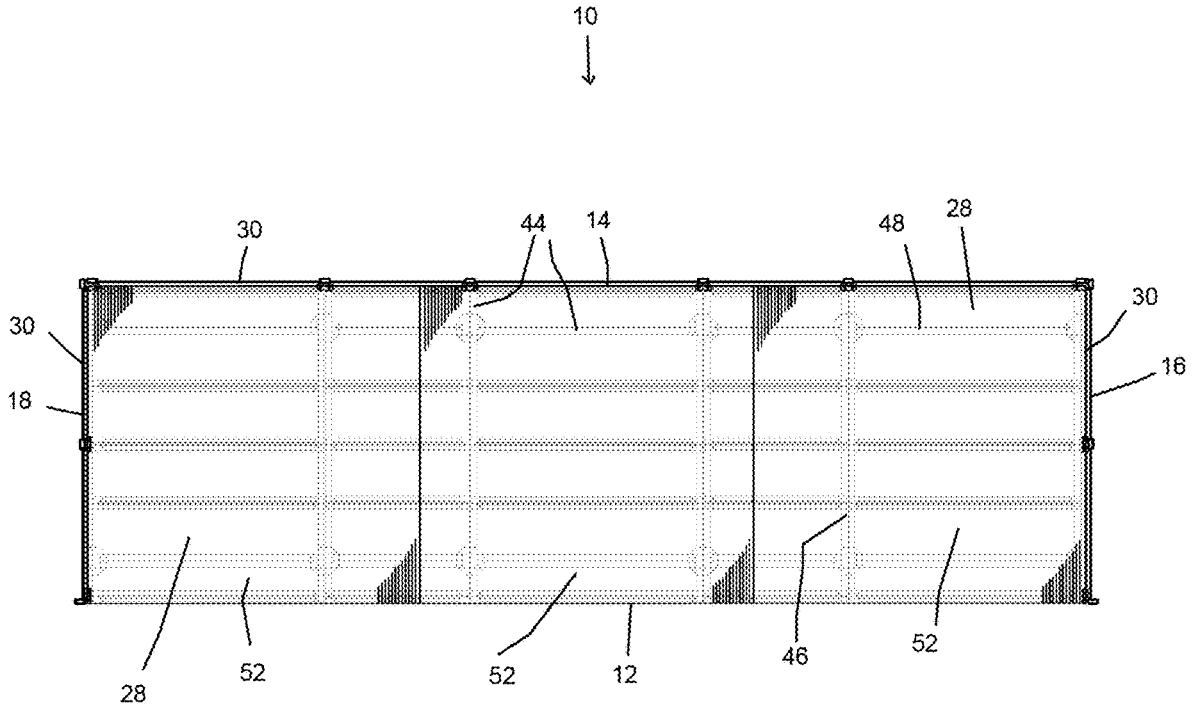
FIG. 1B is a top planar view of the sidewalk shed of FIG. 1A.

FIG. 1B is a top planar view of the sidewalk shed 10 of FIG. 1A. As depicted in FIG. 1B, the decking 28 is disposed above the beam support structure 44, which includes cross or header beams 46 and longitudinal or running beams 48. Again as depicted in FIG. 1B, the decking 28 may be transparent or translucent, including transparent or translucent decking panels 52.

Figure 1C:
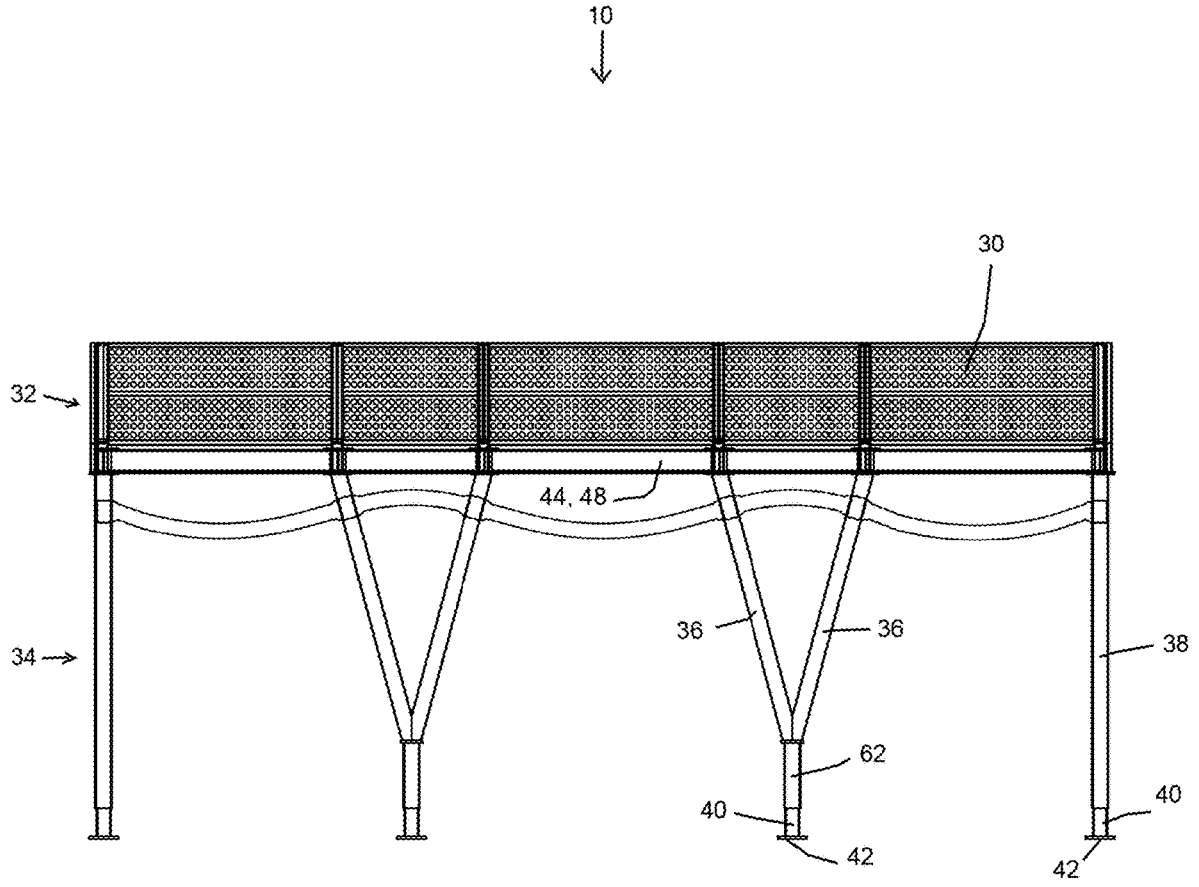
FIG. 1C is a front elevational view of FIG. 1A.
Figure 1D:
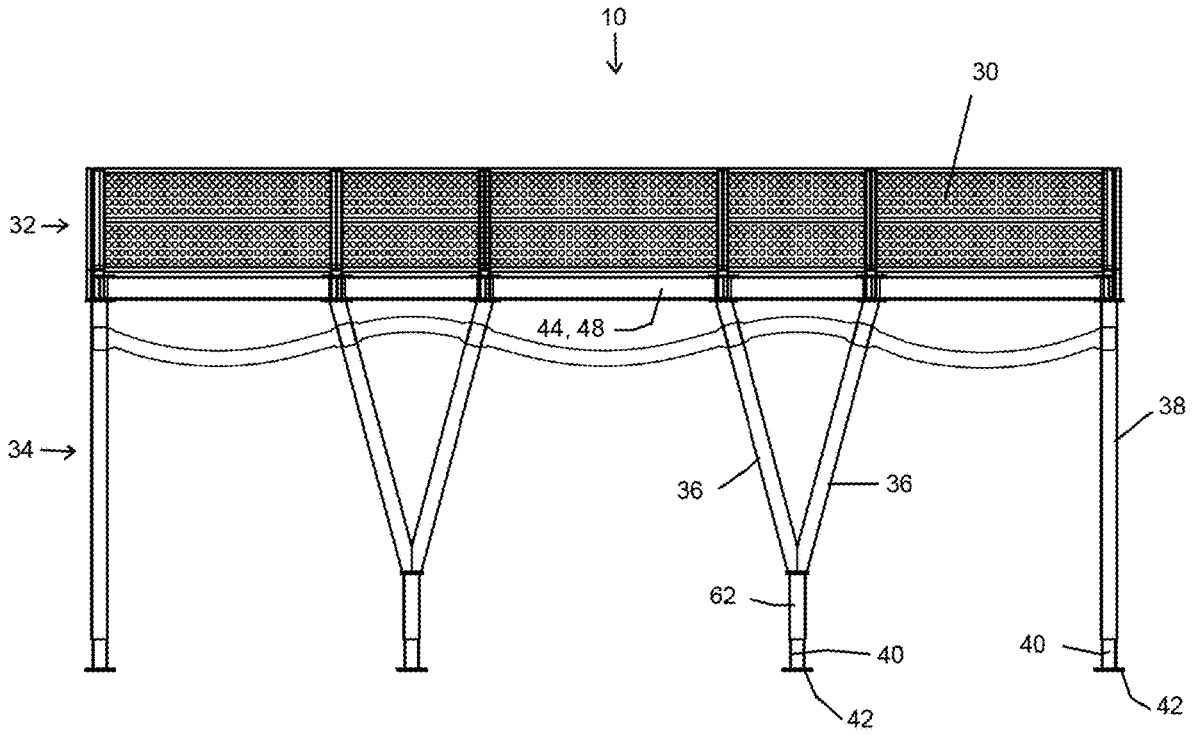
FIG. 1D is a rear elevational view of FIG. 1A.

FIG. 1C is a front elevational view of the sidewalk shed 10 of FIG. 1A. FIG. 1D is a rear evaluation view of the sidewalk shed 10 of the FIG. 1A. Although the front and rear elevational views of FIGS. 1C and 1D are depicted as being similar, including substantially similar, the present invention is not so limited. For example, different features or components may be suitably disposed so as to present in one view, but not the other.

As depicted in FIGS. 1C and 1D, the overhead canopy support arrangement 34 includes single leg support arrangements 38 and dual leg support arrangements 36 securably disposed to the beam support structure 44. While the single and dual leg support arrangements 38, 36 are depicted as being disposed below the beam support structure 44, the present invention is not so limited. For example, some upper portions of these arrangements 38, 36 may be disposed at side portions of the beam support structure 44 or even above portions of the beam support structure 44.

Figure 1E:
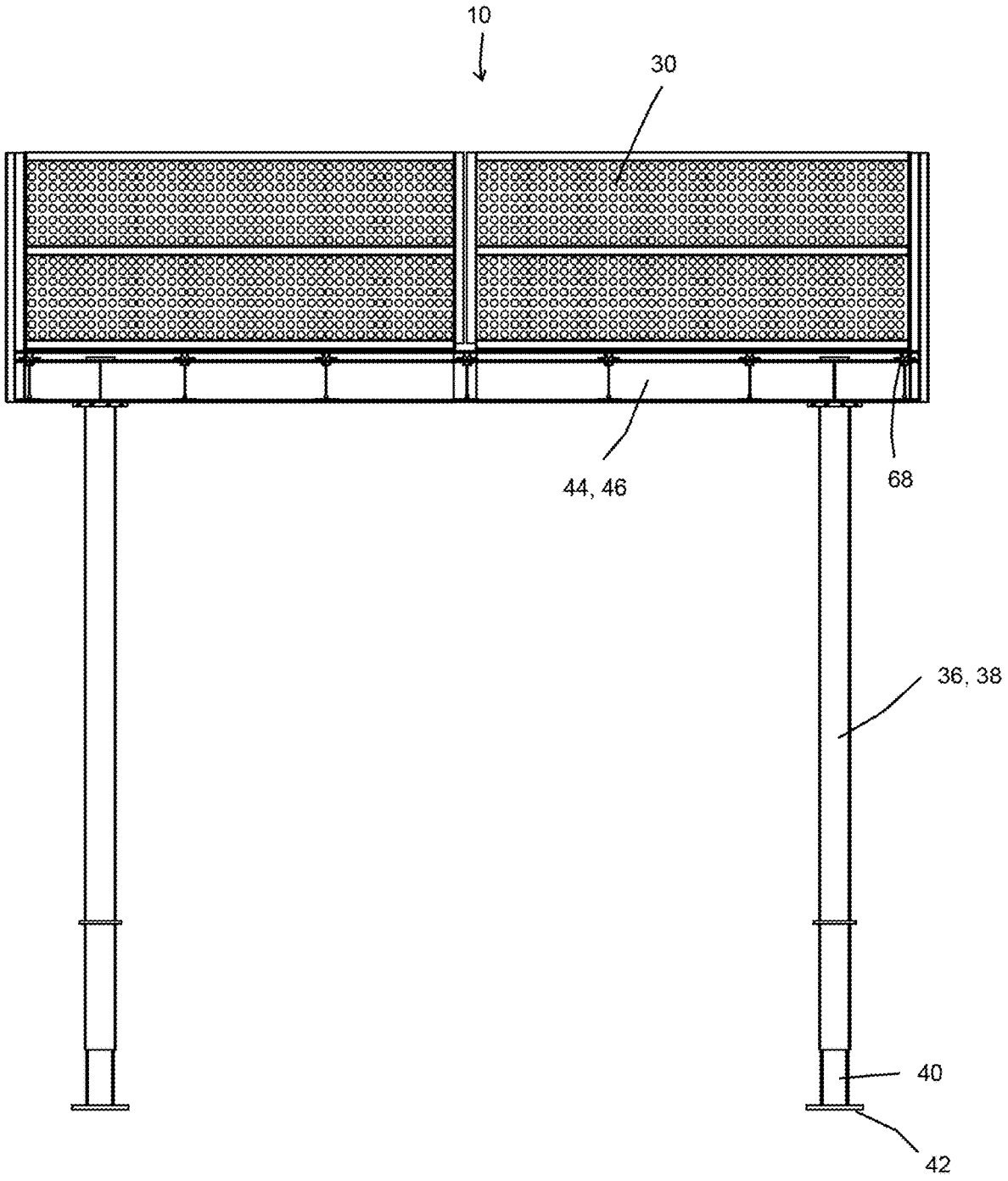
FIG. 1E is a right elevational view of FIG. 1A.
Figure 1F:
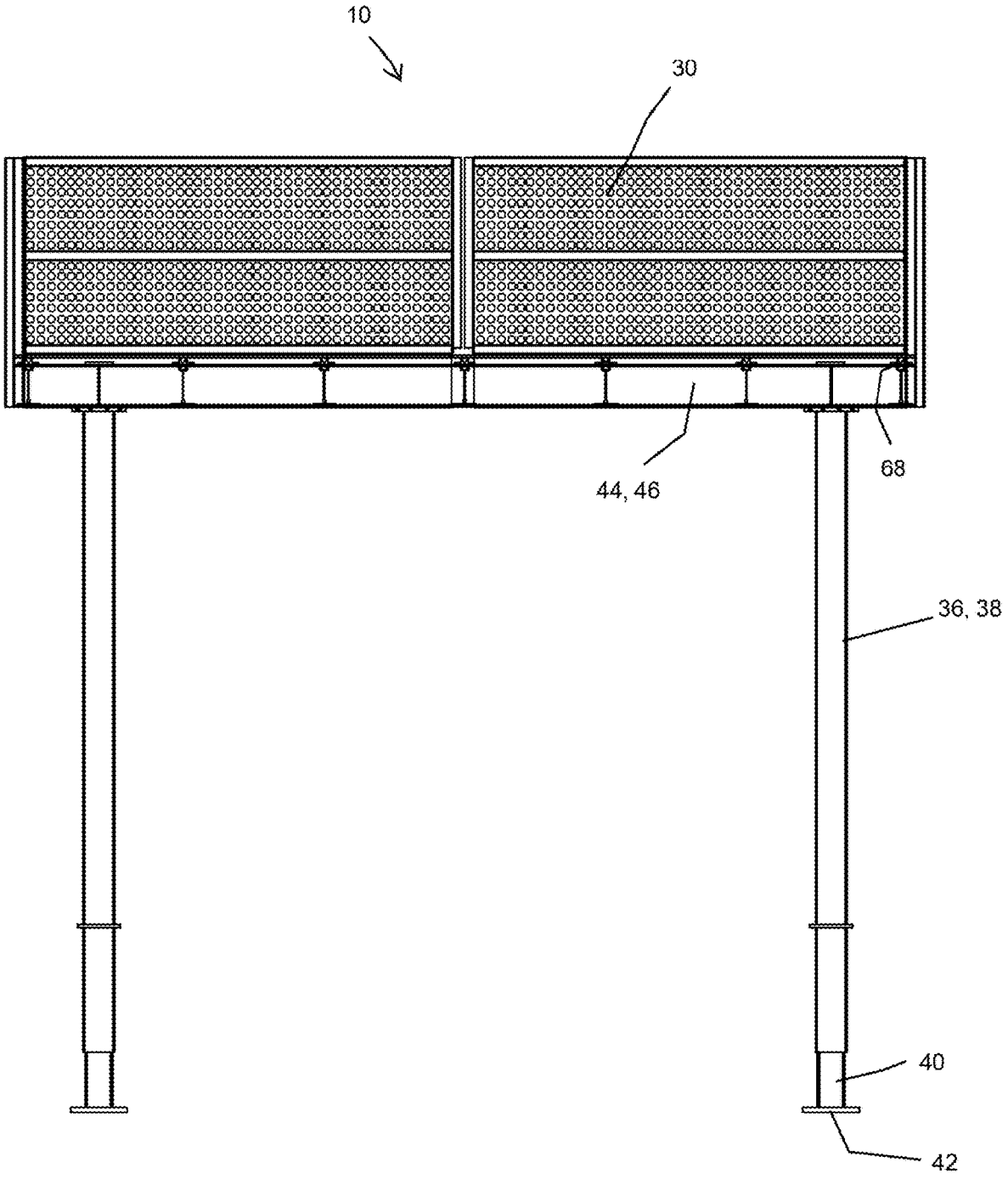
FIG. 1F is a left elevational view of FIG. 1A.

FIG. 1E is a right elevational view of the sidewalk shed 10 or a portion of the sidewalk shed 10 of FIG. 1A. FIG. 1F is a left elevational view of the sidewalk shed 10 or a portion of the sidewalk shed 10 of FIG. 1A. Although the right and left elevational views of FIGS. 1E and 1F are depicted as being similar, including substantially similar, the present invention is not so limited.

Bolt/nut arrangements 68 may be used to secure portions of the sidewalk shed 10 together. For example, bolt/nut arrangements 68 may be used to secure the overhead canopy arrangement 32 and the overhead canopy support arrangement 34 to each other. For example, portions or components of the parapet wall 30 and/or the decking 28 may be secured to the beam support structure 44 via the bolt/nut arrangements 68. The present invention is not limited to the use of bolt/nut arrangements, and other suitable securement components may be used.

Figure 1G:
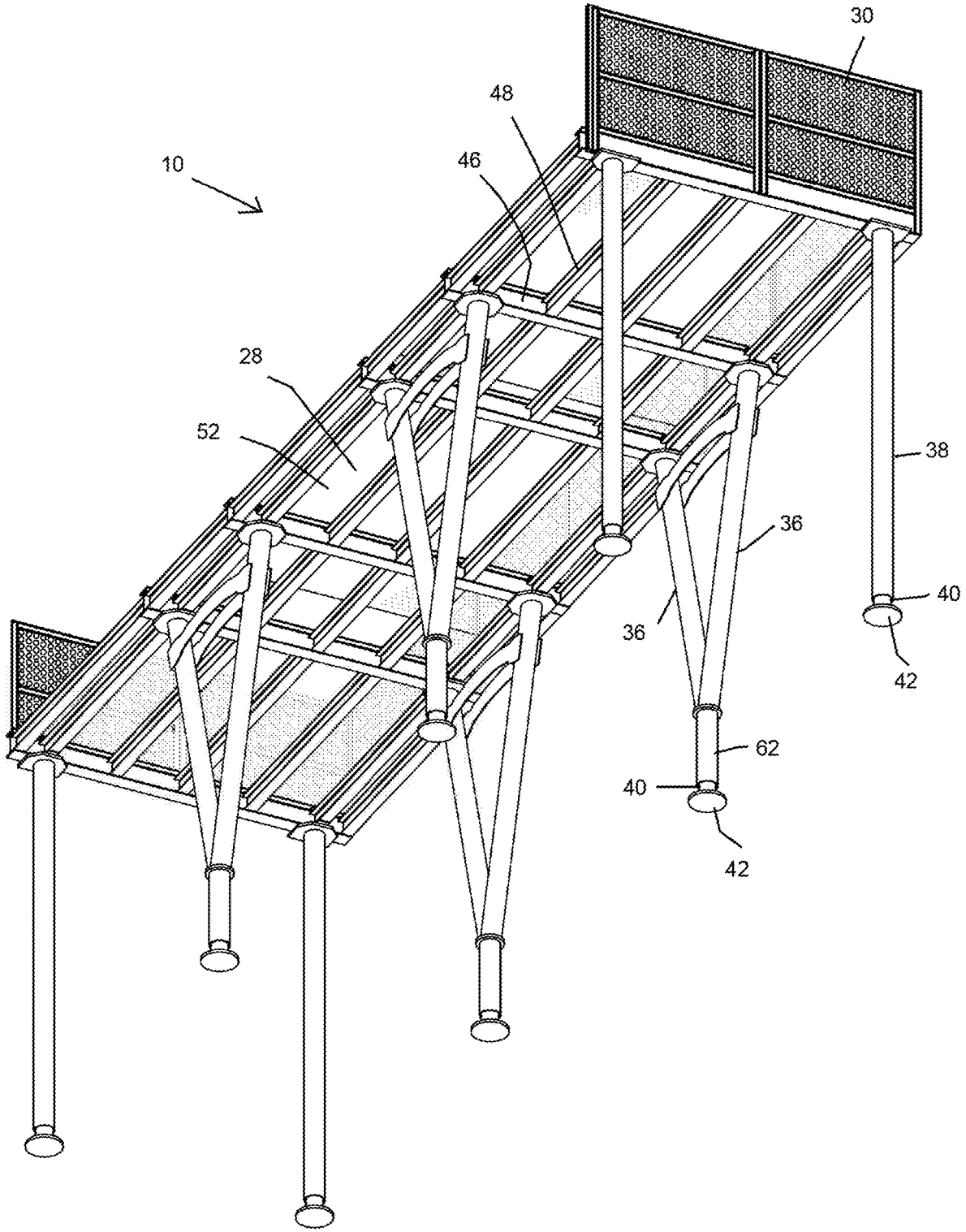
FIG. 1G is a bottom perspective view of FIG. 1A.

FIG. 1G is a bottom perspective view of the sidewalk shed 10 of FIG. 1A. FIG. 1G further depicts the arrangement of the different dual and single leg support arrangements 36, 38 to the beam support structure 44, such as the cross or header beams 46 and/or the longitudinal or running beams 48. As depicted in FIG. 1G, each upper portion of the different dual and single leg support arrangements 36, 38 are secured to the beam structure 44.

Figure 2A:
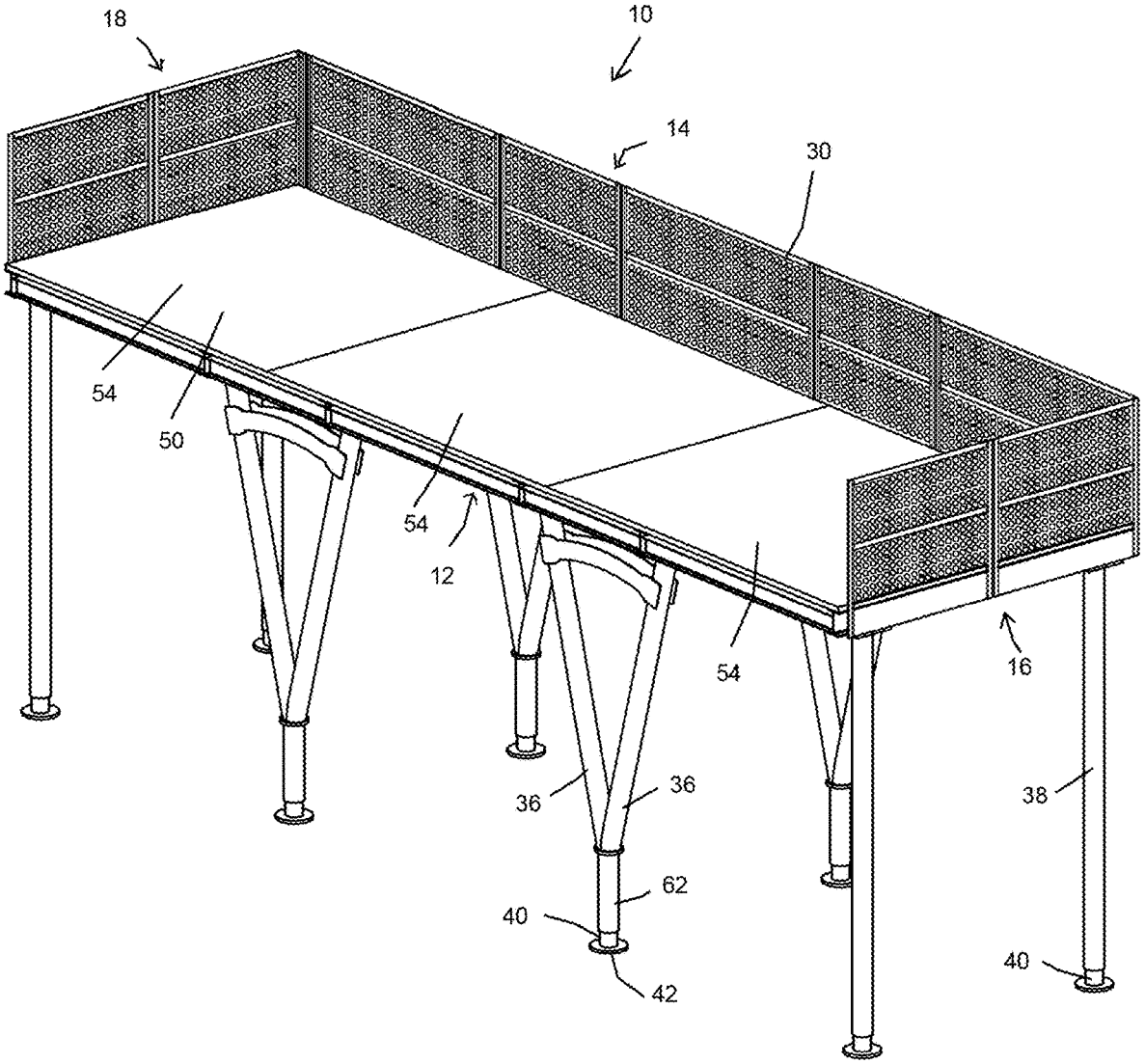
FIG. 2A is a top perspective view of the sidewalk shed of the present invention having opaque decking.
Figure 2B:
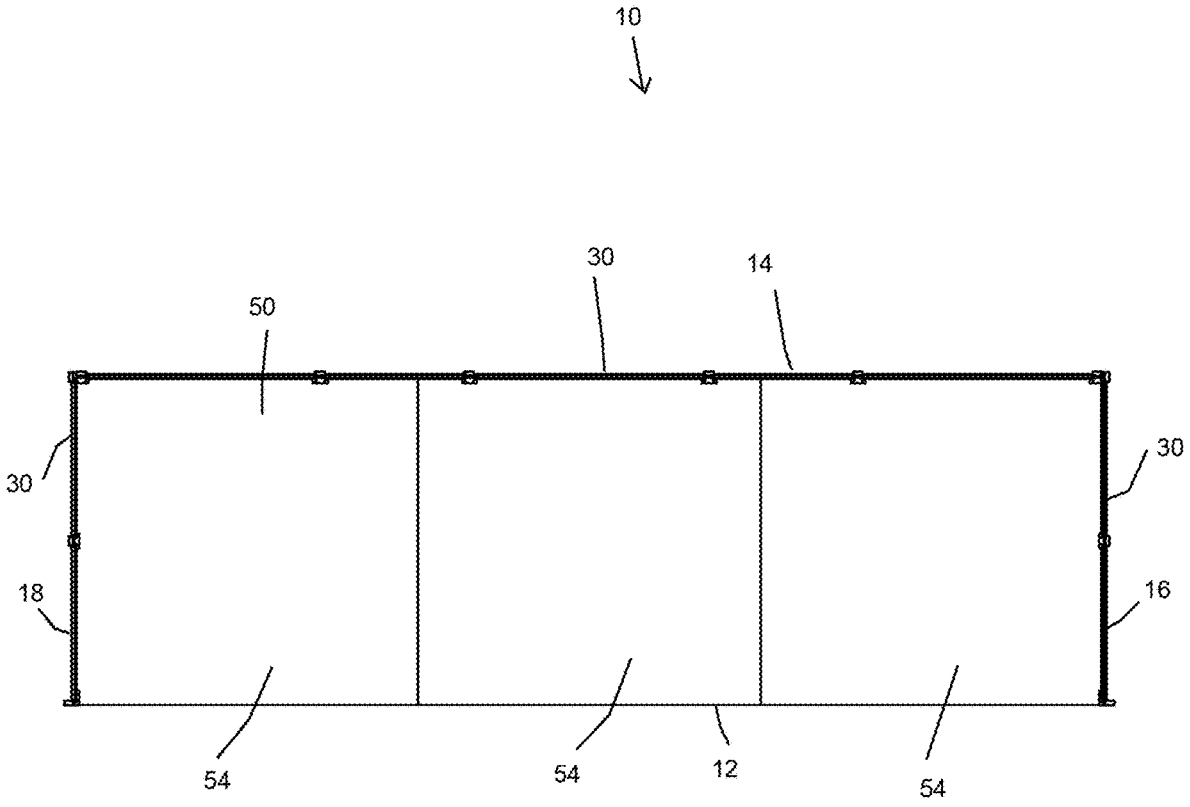
FIG. 2B is a top planar view of the sidewalk shed of FIG. 2A.
Figure 2C:
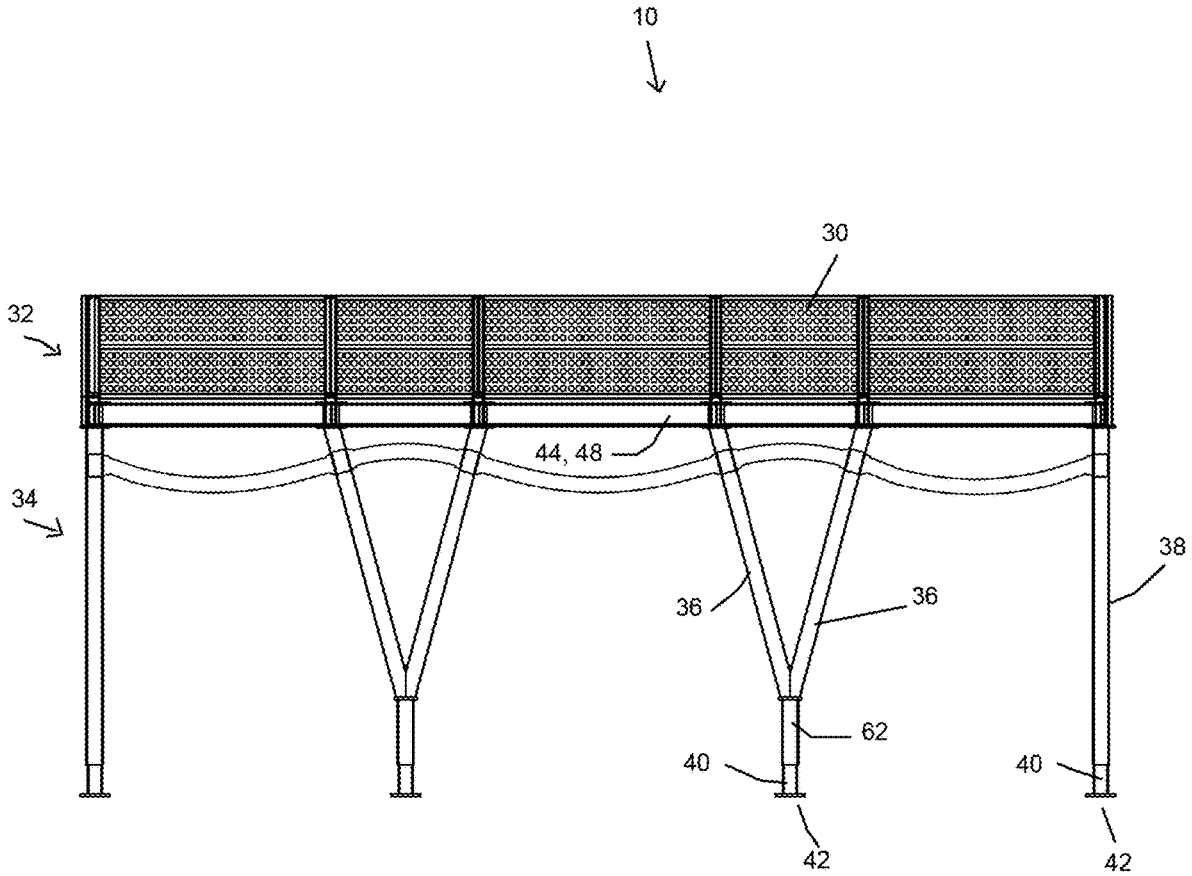
FIG. 2C is a front elevational view of FIG. 2A.
Figure 2D:
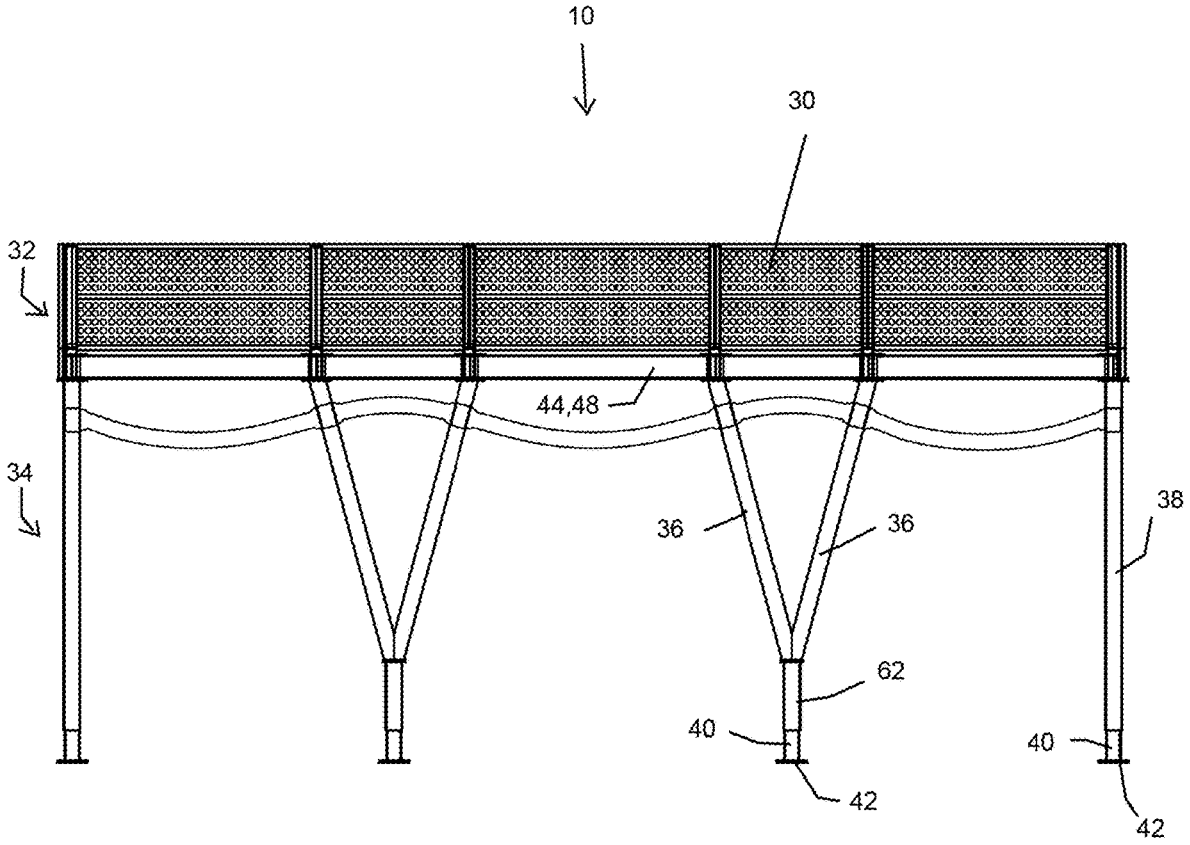
FIG. 2D is a rear elevational view of FIG. 2A.
Figure 2E:
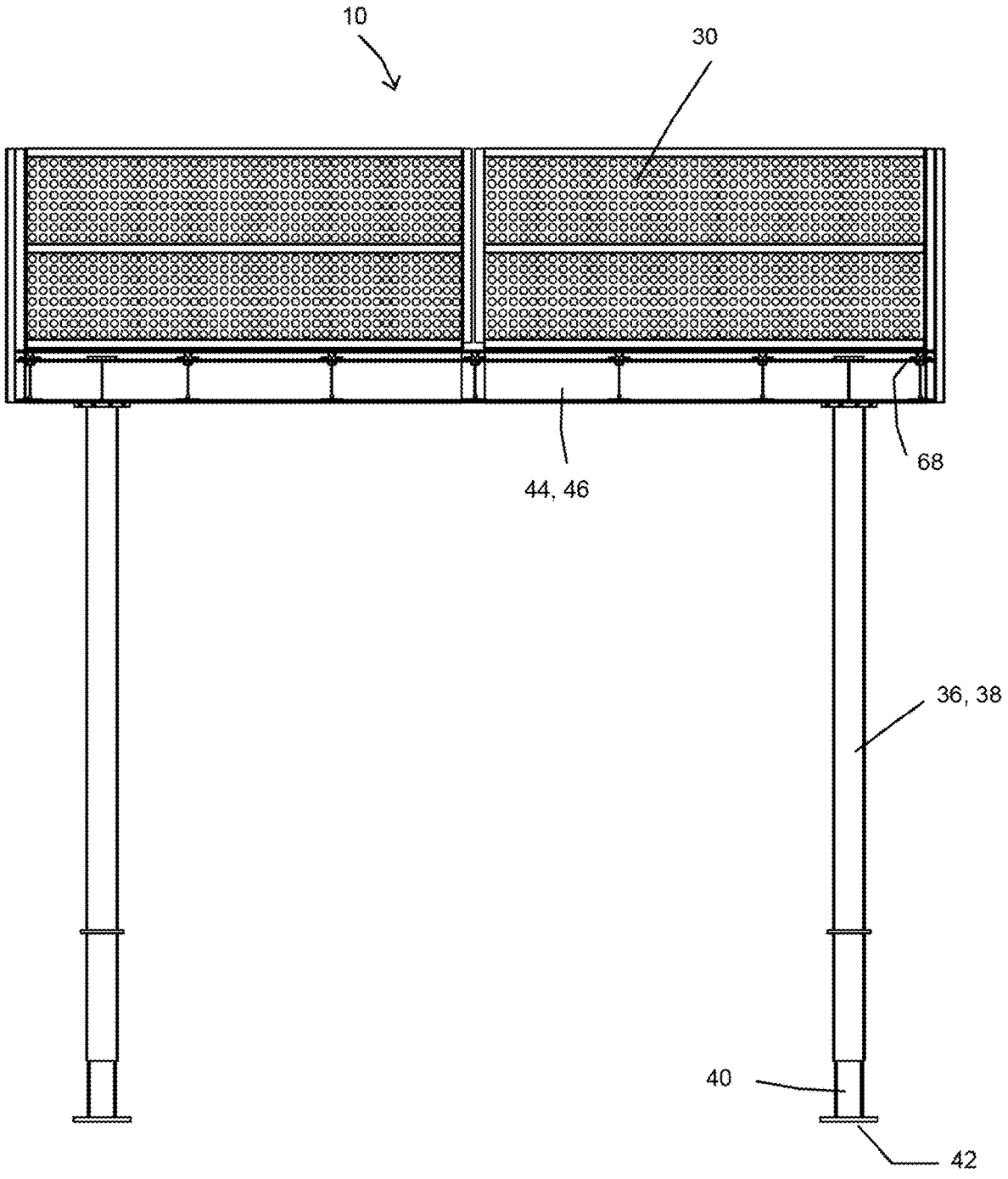
FIG. 2E is a right elevational view of FIG. 2A.
Figure 2F:
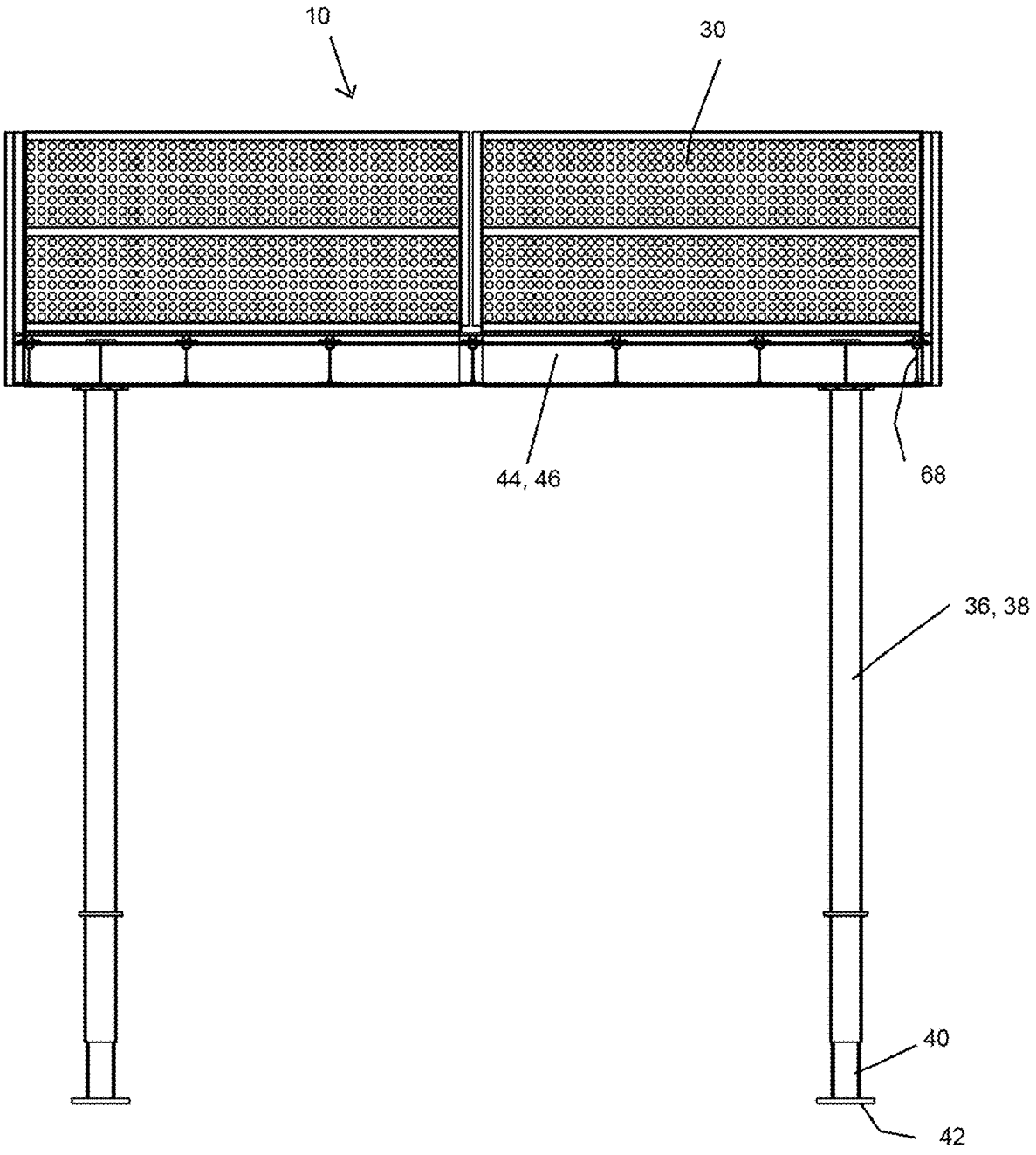
FIG. 2F is a left elevational view of FIG. 2A.
Figure 2G:
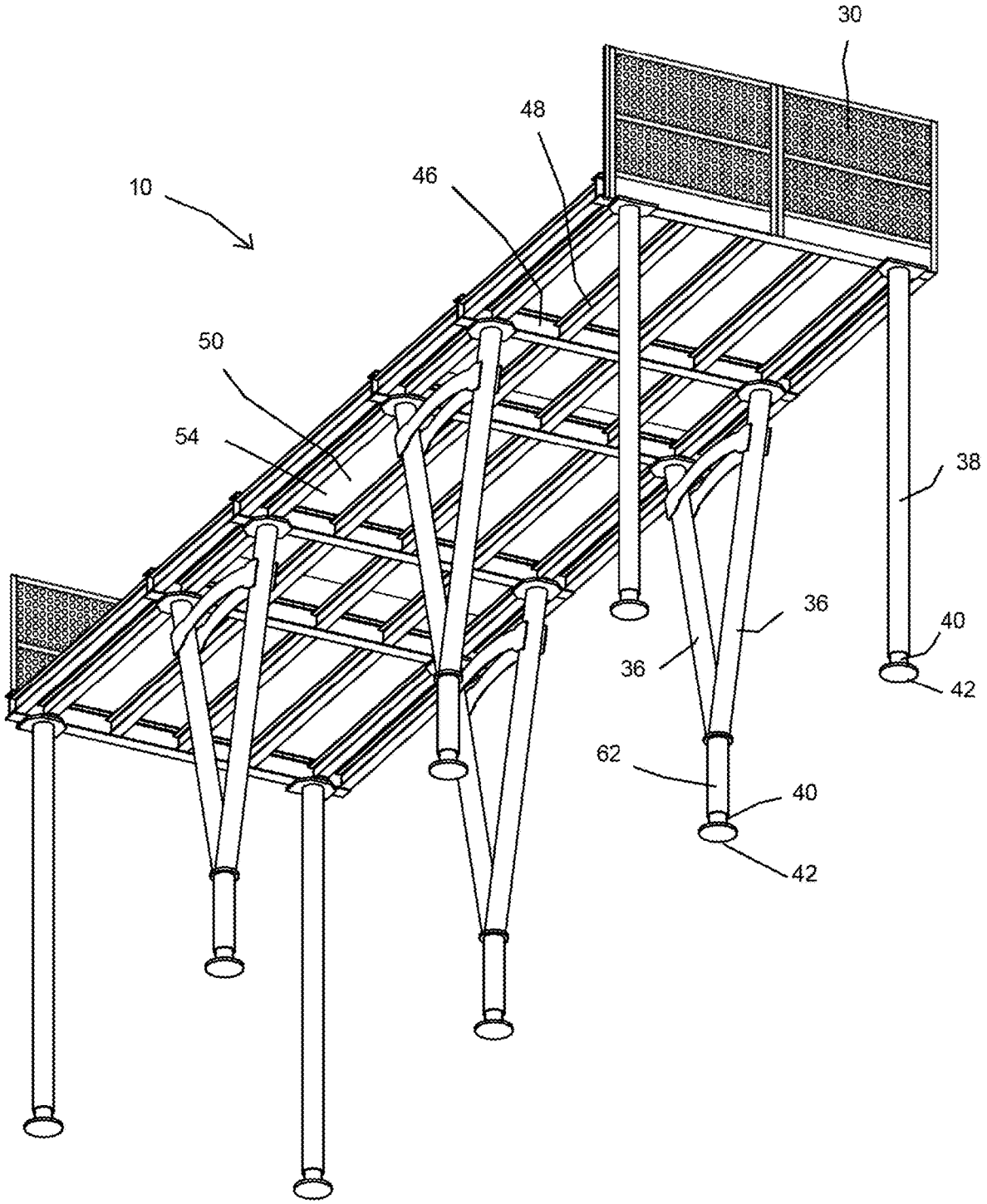
FIG. 2G is a bottom perspective view of FIG. 2A.

FIGS. 2A through 2G depict the sidewalk shed 10 of the present invention having opaque decking 50. The opaque decking 50 includes opaque decking panels 54. Other features of depicted in FIGS. 2A through 2B are similar to those depicted in FIGS. 1A through 1G.

Although not shown, the sidewalk shed 10 of the present invention may include both the transparent or translucent decking panels 52 and the opaque decking panels 54. Moreover, while the transparent or translucent decking panels 52 and the opaque decking panels 54 are depicted as being solid panels, the present invention is not so limited. The panels 52, 54 may be of any suitable material or materials, including natural materials, polymeric materials, synthetic materials, and/or metallic materials.

Figure 3:
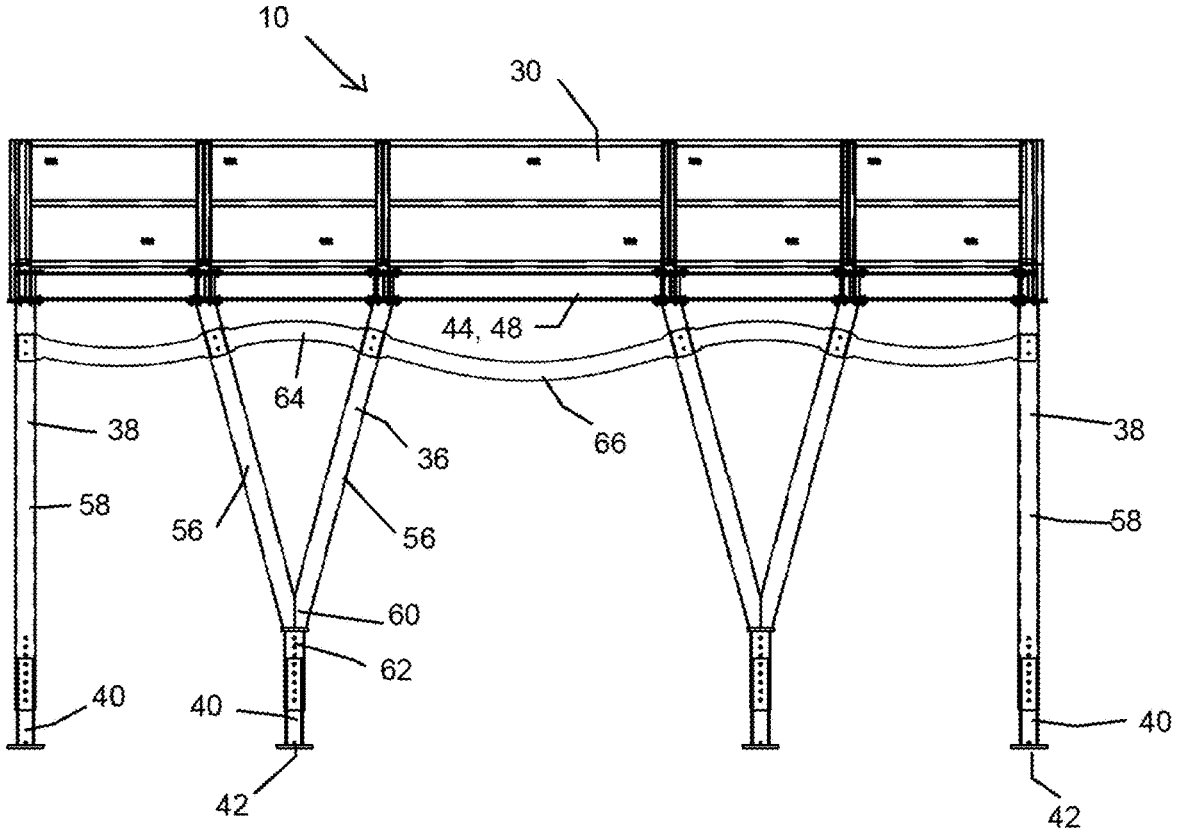
FIG. 3 is a front elevational view of the decking and parapet wall arrangement or overhead canopy and the overhead canopy support arrangement of the sidewalk shed of the present invention.

FIG. 3 is a front elevational view of the sidewalk shed 10 of the present invention. The upper portion of the sidewalk shed 10 may be referred to as a decking/parapet wall arrangement or more simply as the overhead canopy 32. The overhead canopy 32 includes, but is not limited to, the decking 28, 50 and the parapet wall 30. The overhead canopy 32 is supported by canopy support arrangement 34 or a plurality of canopy support arrangements 34. The canopy support arrangements 34 include, but are not limited to, beam support structure 44 and multiple single and dual leg support arrangements 38, 36. While only four total single and dual leg support arrangements 38, 36 are depicted in FIG. 2, the number of single and dual leg support arrangements 38, 36 may vary. For example, sidewalk sheds 10 having larger lengths may have more single and dual leg support arrangements 38, 36 than those having shorter lengths. Other construction details may also impact the number of single and dual leg support arrangements 38, 36 used for a particular sidewalk shed 10.

As depicted in FIG. 3, such dual leg support arrangements 36 have two upper support members 56 for supporting the canopy 34 via the beam structure 44. The present invention, however, is not limited to the use of two upper support members 56 in the canopy support arrangements 34. For example, a canopy support arrangement 34 may include a third support member or further support members 56 (not shown). Further, the canopy support arrangements 34 may include a single leg support arrangement 38. Such single leg support arrangements 38 may be disposed, if desired, at the terminal ends or corners of the sidewalk shed 10, or even at intermediate portions of the sidewalk shed 10.

The canopy support arrangements 34 or the single and dual leg support arrangements 38, 36 include a base member 40. The base member 40 is securable to grade, typically a sidewalk or other passage way. The dual leg support arrangements 36 include the base member 40, a lower support member 62, and at least two upper support members 56, interconnected as shown in, for example, FIG. 3. The single leg support arrangements 38 include the base member 40 and an upper support member 58, inter connected as shown in, for example, FIG. 3. If desired, the single leg support arrangements 38 may optionally include a lower support member (not shown), similar to the lower support member 62, but configured to be securably engageable to the upper support member 58 and the base member 40.

Figure 4:
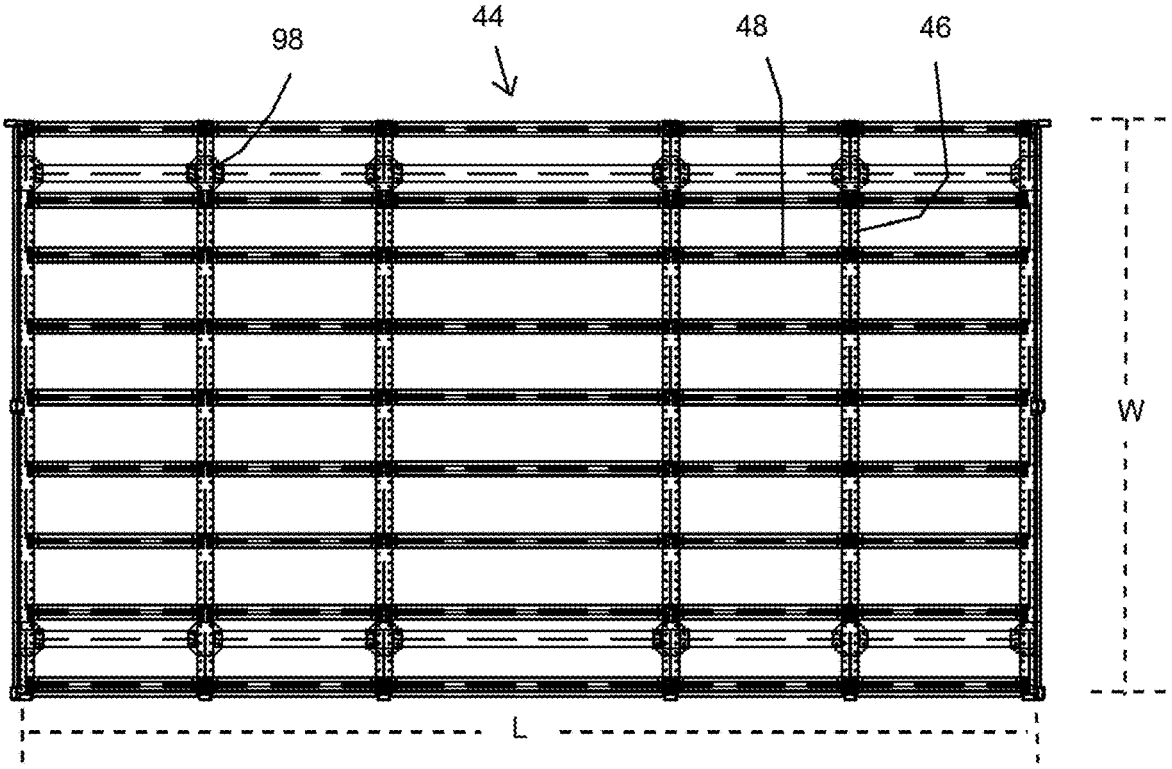
FIG. 4 is a top planar view of the beam support structure of the sidewalk shed of the present invention.

FIG. 4 is a top view of the beam support structure 44 of the sidewalk shed 10 of the present invention. As depicted in FIG. 4, the beam support structure 44 includes cross or header beams 46 and longitudinal or running beams 48, inter-related as shown. The decking panels 52, 54 (not shown in FIG. 4) may be securably disposed above the header beams 46 and/or the running beams 48. The header beams 46 may extend along the width (W) of the beam support structure 44 or the width of sidewalk shed 10. One end of the cross beams 46 is typically disposed proximal to a building (not shown) with an opposed end disposed away from the building. The running beams 48 may extend along the length (L) of the beam support structure 44 or the sidewalk shed 10. Typically, the running beams 48 are parallel to the face of a building (not shown), and the header beams 46 are orthogonal, typically perpendicular, to the face of the building (not shown). The present invention, however, is not so limited to such a geometric orientation of the header beams 46 and the running beams 48, and other orientations may suitably be used. Having the sidewalk shed 10 proximally disposed, including adjacently juxtaposed, to a face of a building may require different orientations of the beams 46, 48 where buildings have irregular and/or non-planar faces, such as curved faces, extending toward pedestrian or otherwise public areas.

The decking panels 52 are depicted as being transparent, including substantially transparent, panels. In one aspect of the present invention the decking panels 52 may be polycarbonate sheets. The thickness and/or strength of the decking panels 52, 54 may vary depending upon anticipated loads and/or safety considerations. For example, the decking panels 52 may be one-half inch (transparent) polycarbonate panels. The thickness of such (transparent) polycarbonate panels may vary. Panel thicknesses greater than one-half inch, for example from about one-half inch to about two inches, including from about one-half inch to about one inch, may be used. Further, panel thicknesses less than one-half inch, for example one-quarter inch to one-half inch, may be used depending upon anticipated loads and/or safety considerations. The panels may have further reinforcement members or materials (not shown). Moreover, the present invention is not limited to the use of transparent panels. The decking panels 52 may be translucent to minimize passage of light or even opaque, such as panels 54, to substantially minimize or block passage of light. Further, while the decking panels 52, 54 are depicted as being solid or substantially solid panels, the present invention is not so limited. For example, the panels may be perforated panels, open-mesh panels, panels having hollow interior portions, and the like. Moreover, the panels 52, 54 may be of any suitable material or materials, including natural materials, polymeric materials, synthetic materials, and/or metallic materials.

FIG. 5 is a side elevational view of a portion of the sidewalk shed 10. The left and right side faces of the parapet wall 30 are not shown, merely for clarity purposes, in this figure; and only the rear side face of the parapet wall 30 is shown. The sidewalk shed 10 will typically include canopy support arrangements 34 disposed proximally towards a face 22 of a building 20 and opposed canopy support arrangements 34 disposed distally from the face 22 of the building 20. The sidewalk shed 10 may be disposed along a sidewalk 24 between the face 22 of a building 20 and a curb 26. The base member 40 may be bolted (bolts not shown) or otherwise secured to the top of a sidewalk 24. The upper support members 56, 58 are secured to the canopy 32, in particular to the header beams 46, via bolt/nut arrangements 68. The decking panels 52, 54 may be secured to the running beams 48 and/or the header beams 46 via any convenient means, such as a nailer (not shown) disposed along upper portions of the running beams 48 and/or the header beams 46. The running beams 48 and the header beams 46 may be securably juxtaposed via any convenient means, such as bolt/nut arrangements 68.

Figure 6:
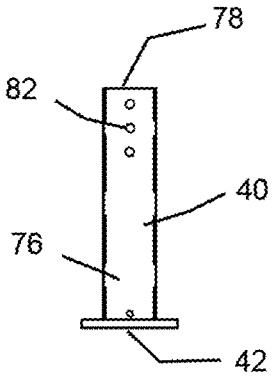
FIG. 6 is a side elevational view of a base member of the sidewalk shed of the present invention.

FIG. 6 is a side elevational view of the base member 40 of the present invention. The base member 40 is desirably a hollow cylindrical member, such as a pipe, and includes a lower portion 76 and an upper portion 78. The lower portion 76 includes a base plate 42. The base plate 42 includes holes (not shown) through which anchors (not shown) may be disposed for securing the base member 40 to grade, such as a sidewalk 24. The upper portion 78 of the base member 40 may include holes 82. The holes 82 are desirably positioned at ninety degree intervals (not shown) around the circumference of the base member 40. As described below, the holes 82 are useful for securing the base member 40 to the lower support member 62 and/or, if desired, to the upper support member 58. The holes 82 allow for height adjustability, as needed, to keep the decking 28, 50 and/or the beam support structure 44 horizontally level. Such height adjustability is not just limited to a single horizontal configuration. For example, the sidewalk shed 10 may include different portions having different heights, such as one or more heights stepped from another height. Further, horizontal configurations may include some degree of sloping to accommodate particular building and/or pedestrian considerations.

Figure 7A:
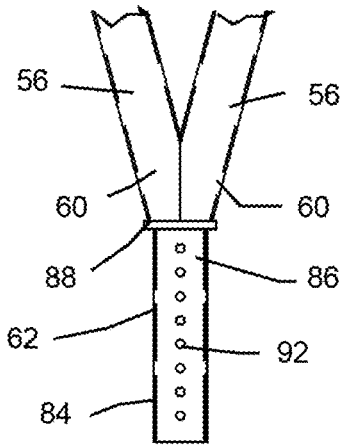
FIG. 7A is a front elevational view of a lower support member of the sidewalk shed of the present invention having welded upper support members secured thereto.
Figure 7B:
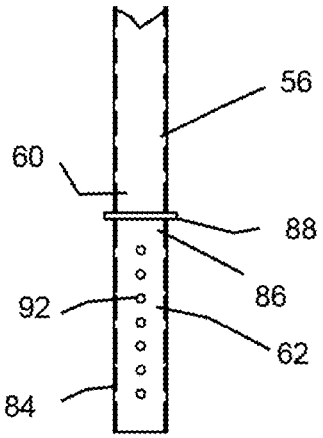
FIG. 7B is a side elevational view of the support member components of FIG. 7A.

FIG. 7A is a front elevational view of the lower support member 62, but with a partial front elevational view of the lower portions 60 of the upper support members 56 of the dual leg support arrangements 36, and FIG. 7B is a side elevational view of the same. Only partial views of the upper support members 56 are depicted merely for convenience. The upper support members 56 are secured to the lower support member 62. Securement may be configured to be a plate 88 disposed between the upper support members 56 and the lower support member 62. The lower portions 60 of the upper support members 56 and the upper portion 86 of the lower support member 62 may be, for example, welded to the plate 88. The present invention, however, is not so limited. Any suitable arrangement (as long as it meets the required structural criteria) of plates, nuts and bolts, and welding may be used to secure the upper support members 56 to the lower support member 62.

The lower support member 62 is desirably a hollow cylindrical member, such as a pipe, and includes a lower portion 84 and an upper portion 86. The lower support member 62 includes holes 92. The holes 92 are desirably positioned at ninety degree intervals (not shown) around the circumference of the lower support member 62. The lower portion 84 of the lower support member 62 may sit outside the base member 40. More broadly, the lower support member 62 may be inter-engageable, including securably inter-engaged, with the upper portion 78 of the base member 40. The position of the lower support member 62 may be adjusted as needed to, for example, keep the decking panels 52, 54 level. Moreover, at least some of the holes 92 of the lower support member 62 may be aligned with at least some of the holes 82 of the base member 40 to allow for securement of these members to each other. Desirably, having the lower support member 62 sitting outside the base member 40 includes sliding engagement, such as the lower support member 62 being slidingly disposed over the base member 40. The present invention is not limited to such an arrangement, and other interconnecting arrangements may suitably be used. For example, the lower portion 84 of the lower support member 62 may be configured to sit inside the base member 40. Desirably, the base member 40 and the lower support member 62 are releasably secured to each other for ease, if desired, for disassembly of the sidewalk shed 10. For example, some of the holes 92 of the lower support member 62 may be aligned with some of the holes 82 of the base member 40. Bolts (not shown) may be disposed through the aligned holes 92 of the lower support member 62 and the aligned holes 82 of the base member 40, and nuts (not shown) may be used to secure the base member 40 and the lower support member 62 over or along the bolts. The bolts may be disposed in directions corresponding to the length (L) of the sidewalk shed 10 and/or corresponding to the width (W) of the sidewalk shed 10. The present invention, however, is not limited to such a bolt/nut arrangement, and other interconnecting arrangements may suitably be used.

Figure 8A:
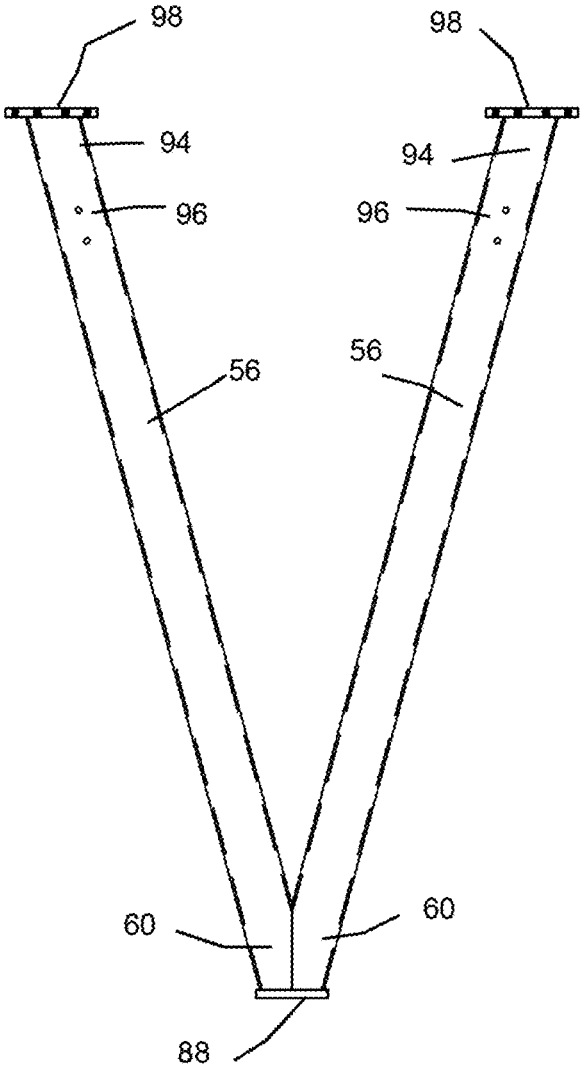
FIG. 8A is a front side elevational view of the welded upper support members that are partially depicted in FIGS. 7A and 7B of the sidewalk shed of the present invention.
Figure 8B:
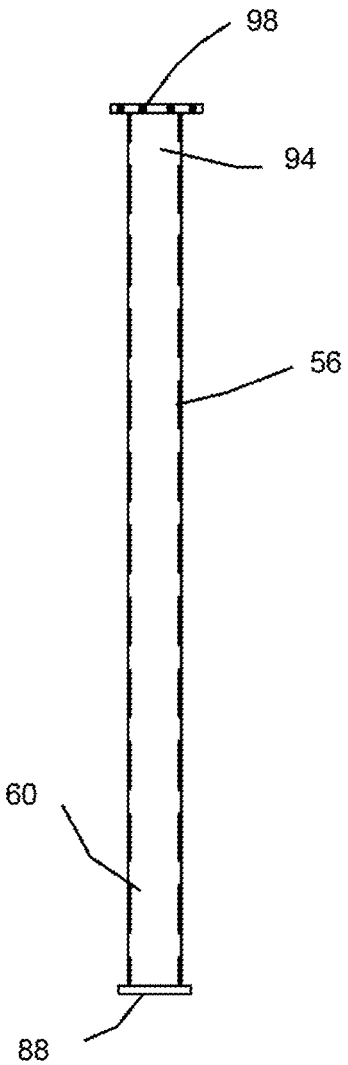
FIG. 8B is a side elevational view of the support member components of FIG. 8A.

FIG. 8A is a front elevational view of upper support member 56, and FIG. 8B is a side elevational view thereof. The upper support member 56 includes a lower portion 60 and an upper portion 56. The lower portion 60 of one upper support member 56 may be secured, for example by welding, to the adjacent or juxtaposed lower portion 60 of another upper support member 56. As described above, the lower portions 60 of the upper support members 56 may also be secured to the plate 88.

The upper portion 94 of the upper support member 56 may include a plate 98. The plate 98 includes holes (not shown) that enable the header beams 46 to frame into, or otherwise inter-engage, with the upper support members 56. The plates 98 may also function as a gravity and/or a moment connection for structural support.

Where only one upper support member 58 is used, the plate 98 may be utilized in the same way or configuration as it is utilized for the upper support member 56. As depicted in FIGS. 3 and/or 5, where only one upper support member 58 is used, holes in the lower portion of the upper support member 58 may be alignable with the holes 82 in the base member 40 for securing these members to each other with the use of bolts and nuts. The present invention, however, is not limited to such a bolt/nut arrangement, and other interconnecting arrangements may suitably be used.

Returning to FIG. 8A, the portion 94 of the upper support member 56 may include holes 96. Holes 96 are useful for securing banner plates 64, 66 to the upper support members 56, 58. For example, as depicted in FIG. 3, the sidewalk shed 10 may include banner plates 64, 66. The banner plates 64, 66 may be substantially horizontal or may be curved as depicted. The banner plates 64, 66 may be provided for aesthetic purposes. Being downwardly curved, banner plate 64 has its ends at a lower elevation from the apex or medial portion. Being upwardly curved, banner plate 66 has its ends at a higher elevation from the medial portion of the curved member. The sidewalk shed 10 of the present invention is not limited to the use of such banner plates 64, 66. The upward or downward curved configuration of the banner plates 64, 66 may vary. Further, the banner plates 64, 66 may be configured to include non-aesthetic purposes. The use of the banner plates 64, 66 is optional, and the sidewalk shed 10 need not include such plates.

Figure 9:
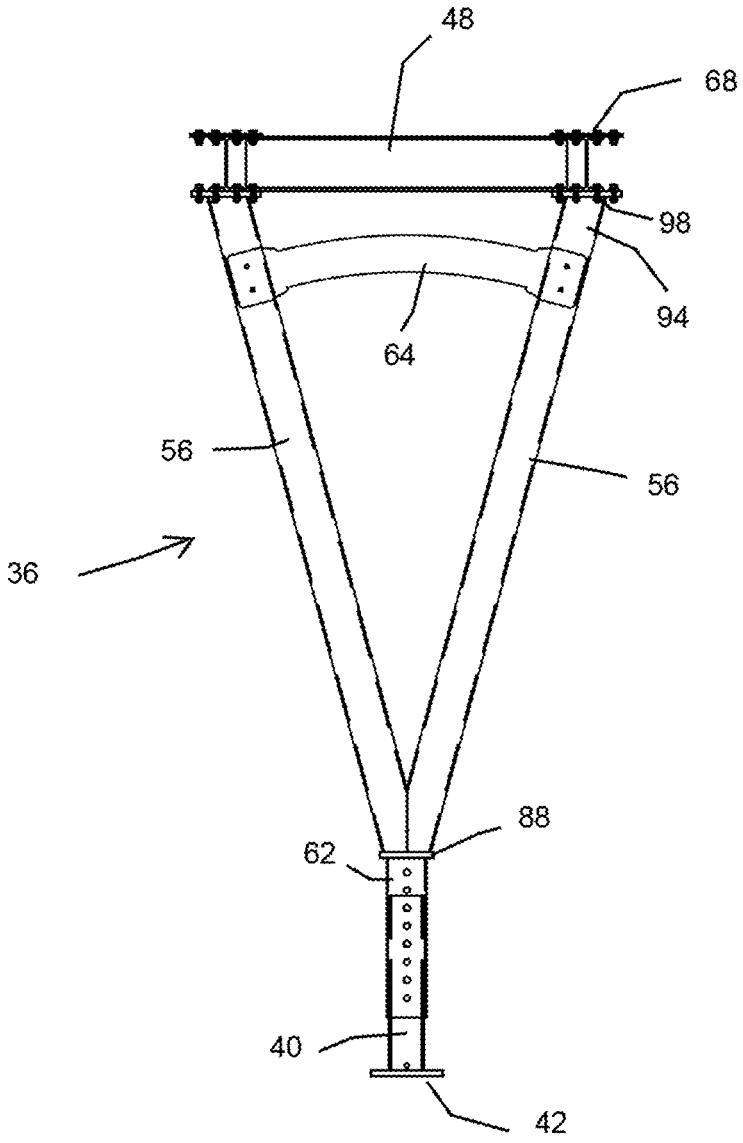
FIG. 9 is a front elevational view detailing assembled base, lower support, and upper support members of the present invention.

FIG. 9 is a front elevational view of the "assembled" dual leg support arrangement 36. The lower support member 62 may be secured to the base member 40 via bolts and nuts (not shown) through the aligned holes of these two members. The upper support members 56 and the lower support members 62 may be welded to plate 88. The banner plate 64 is an addition, such as an aesthetic addition, that is bolted or otherwise secured to the upper portions 94 of the upper support members 56. The plates 98 at the upper portions 94 of the support members 56 may be secured to the running beams 48 via bolt and nut arrangements 68.

The base member 40; the lower support member 62; the upper support members 56, 58; and the banner plates 64, 66 may comprise any suitable construction material. Desirably, the construction material is a metallic material or materials. Steel and aluminum materials are especially useful. The material of construction for the base member 40; the lower support member 62; the upper support members 56, 58; and the banner plates 64, 66 may be the same or may be different.

Figure 10:
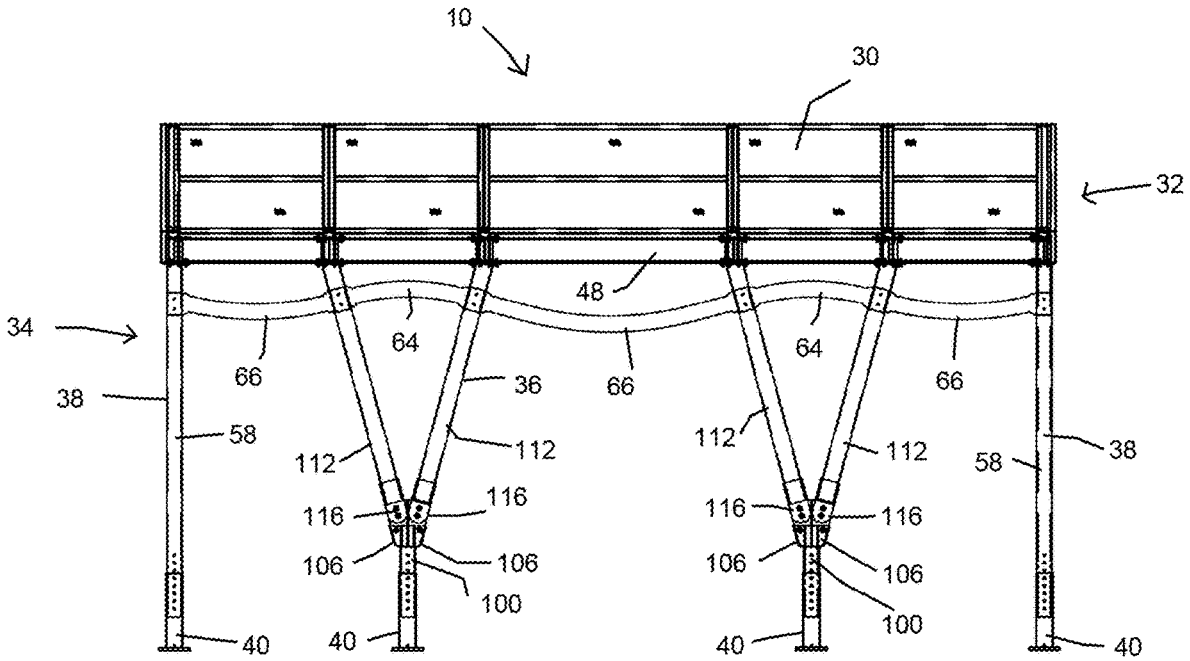
FIG. 10 is a front elevational view of the sidewalk shed of the present invention having a bolted arrangement at the lower portion of the upper support members.

The present invention, however, is not limited to having the lower portions 60 of adjacent or juxtaposed upper support members 56 being welded to each other. As depicted in FIGS. 10-15, the upper support members 112 may be secured to the lower support members 100 via plates and nut/bolt arrangements. FIG. 10 is a front elevational view of the sidewalk shed 10 of the present invention having such plates and nut/bolt arrangements. FIG. 11 is a side elevational of the sidewalk shed 10 having such plates and nut/bolt arrangements being proximally disposed to a building 20. Corresponding reference element numbers or characters in FIGS. 10-15 indicate corresponding parts throughout the several views of the drawings of FIGS. 1-9.

Figure 13A:
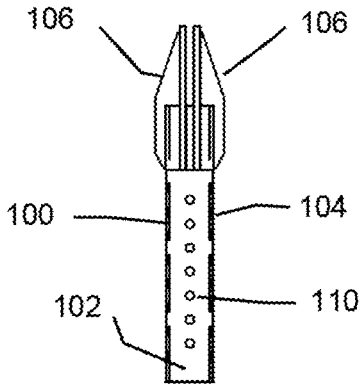
FIG. 13A is a side elevational view of a lower support member of the sidewalk shed of FIG. 10.
Figure 13B:
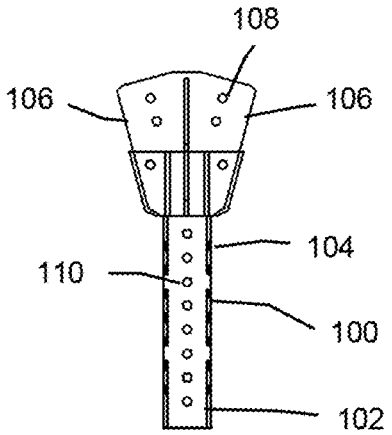
FIG. 13B is a front elevational view of a lower support member of the sidewalk shed of FIG. 10.
Figure 12:
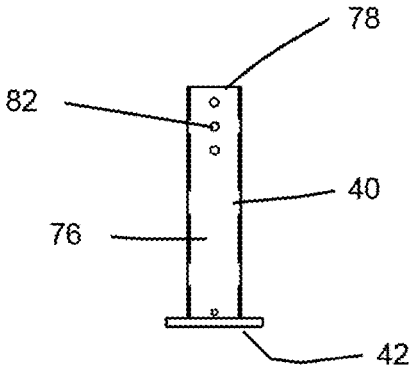
FIG. 12 is a side elevational view of the base member of FIG. 10.

As depicted in FIGS. 13A and 13B, the upper portion 104 of the lower support member 100 may include plates 106. The plates 106 may be paired and spaced apart as shown. The plates 106 may include holes 108. Such plates 106 and holes 108 are useful in securing the lower support member 100 to the upper support member 112. As depicted in FIG. 12, the base member 40 may be the same or similar as described above, for example in conjunction with FIG. 6.

Figure 14A:
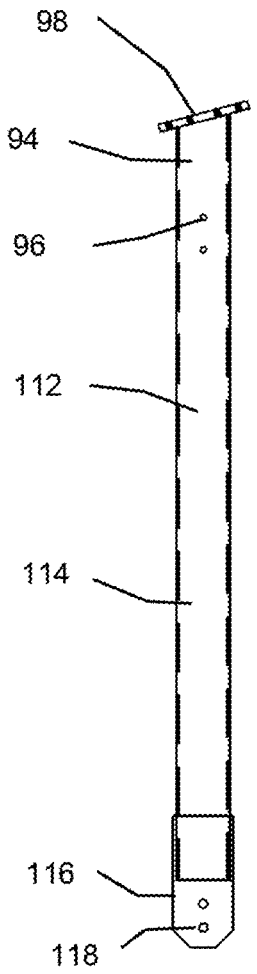
FIG. 14A is a front elevational view of the upper support members of the sidewalk shed of FIG. 10.
Figure 14B:
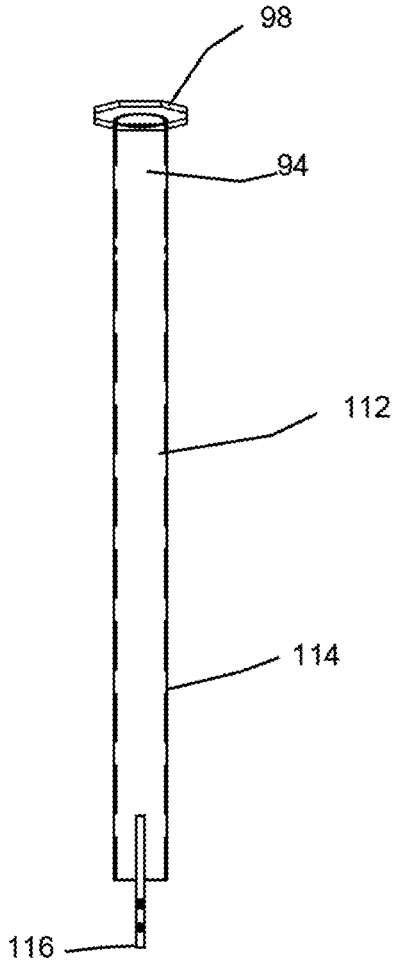
FIG. 14B is a side elevational view of the upper support members of the sidewalk shed of FIG. 10.

FIG. 14A is a front elevational view of upper support member 112, and FIG. 14B is a side elevational view of the upper support member 112. The upper support member 112 includes a lower portion 114 and an upper portion 94. The lower portion 114 of the upper support member 112 includes a plate 116. The plate 116 includes holes 118. The holes 118 of the plate 116 of the upper support member 112 are alignable with the holes 108 of the plates 106 of the lower support member 100.

Figure 15:
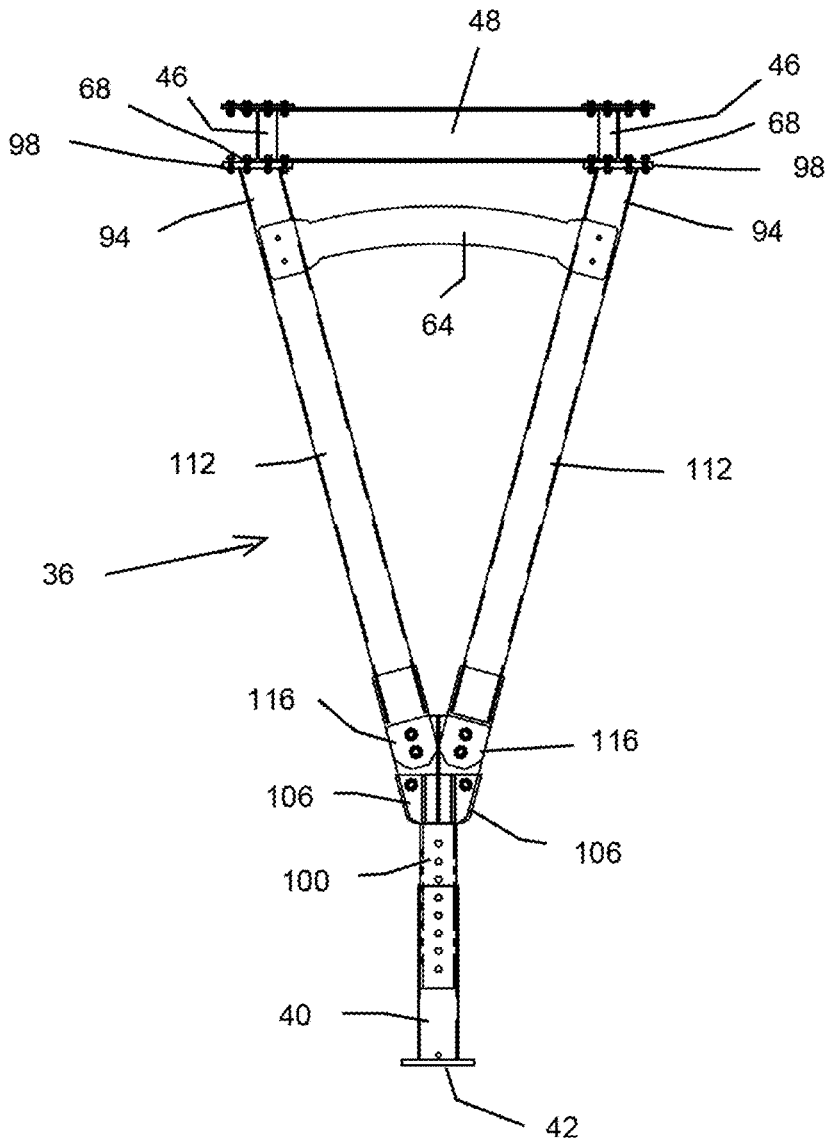
FIG. 15 is a front elevational view detailing assembled base, lower support and upper support members of the sidewalk shed of FIG. 10.

FIG. 15 is a front elevational view of the "assembled" dual leg support arrangement having the above-described plates 106, 116 securably juxtaposed, such as by bolt and nut arrangements (not shown) for joining or securing support members 100, 112.

Figure 16A:
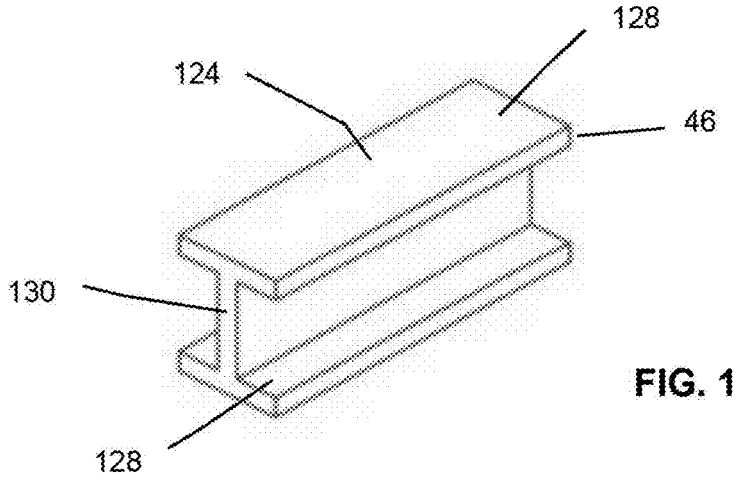
FIG. 16A is a perspective view of an I-beam useful with the sidewalk shed of the present invention.
Figure 16B:
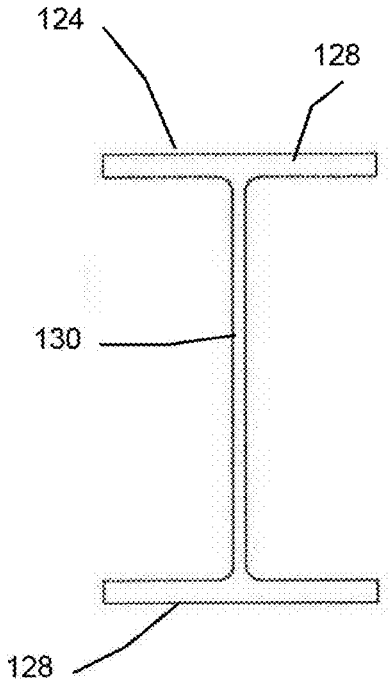
FIG. 16B is a side view of the I-beam of FIG. 16A useful with the sidewalk shed of the present invention.
Figure 16C:
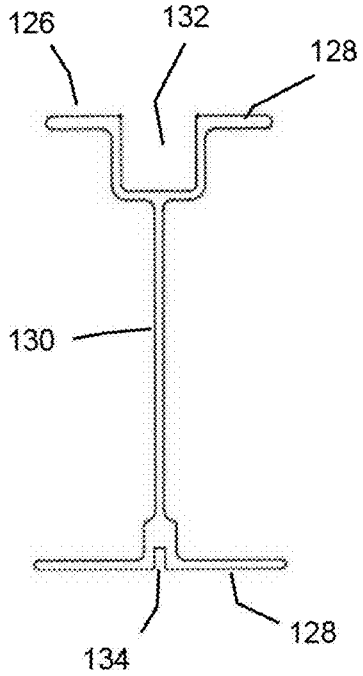
FIG. 16C is a side view of a ledger beam useful with the sidewalk shed of the present invention.

FIGS. 16A through 16C depict non-limiting examples of beams useful with the sidewalk shed 10 of the present invention. FIG. 16A is a perspective view of I-beam 124 and FIG. 16B is a side view of I-beam 124 of FIG. 16A. I-beam 124 has opposed flanges 128 inter-joined by a web 130. The use of the term "I-beam" refers to a beam having opposed and substantially parallel flanges with a centrally disposed web. Such beams may also be referred to as H-beam, W-beam, and the like. The I-beam 124 may be used as the header beam 46, the running beam 48, and combinations thereof. In one aspect of the present invention, at least one or more of the header beams 46 are I-beams 124.

FIG. 16C is a side view of a ledger or I-beam 126. The ledger or I-beam 126 includes opposed upper and lower flanges 128 inter-joined by a web 130. In addition, the upper flange 128 depicted in FIG. 16C may include an upper notch 132, and the lower flange 128 depicted in FIG. 16C may include a lower notch 134. The upper notches 132 of the ledger or I-beam 126, including but not limited to top flange portions of the running beam 48, may be utilized to secure the decking panels 52, 54. For example, a nailer (not shown) may be disposed inside the upper notches 132 for having the panels disposed there over. The lower notch 134 may be useful for containing other features, such as wiring for lights (not shown), for the sidewalk shed 10.

Desirably, the construction materials for I-beams 124, 126 are metallic materials. Steel and aluminum materials are especially useful. The material of construction for the I-beams 124, 126, header beams 46, and running beams 48 may be the same or may be different.

Figure 17:
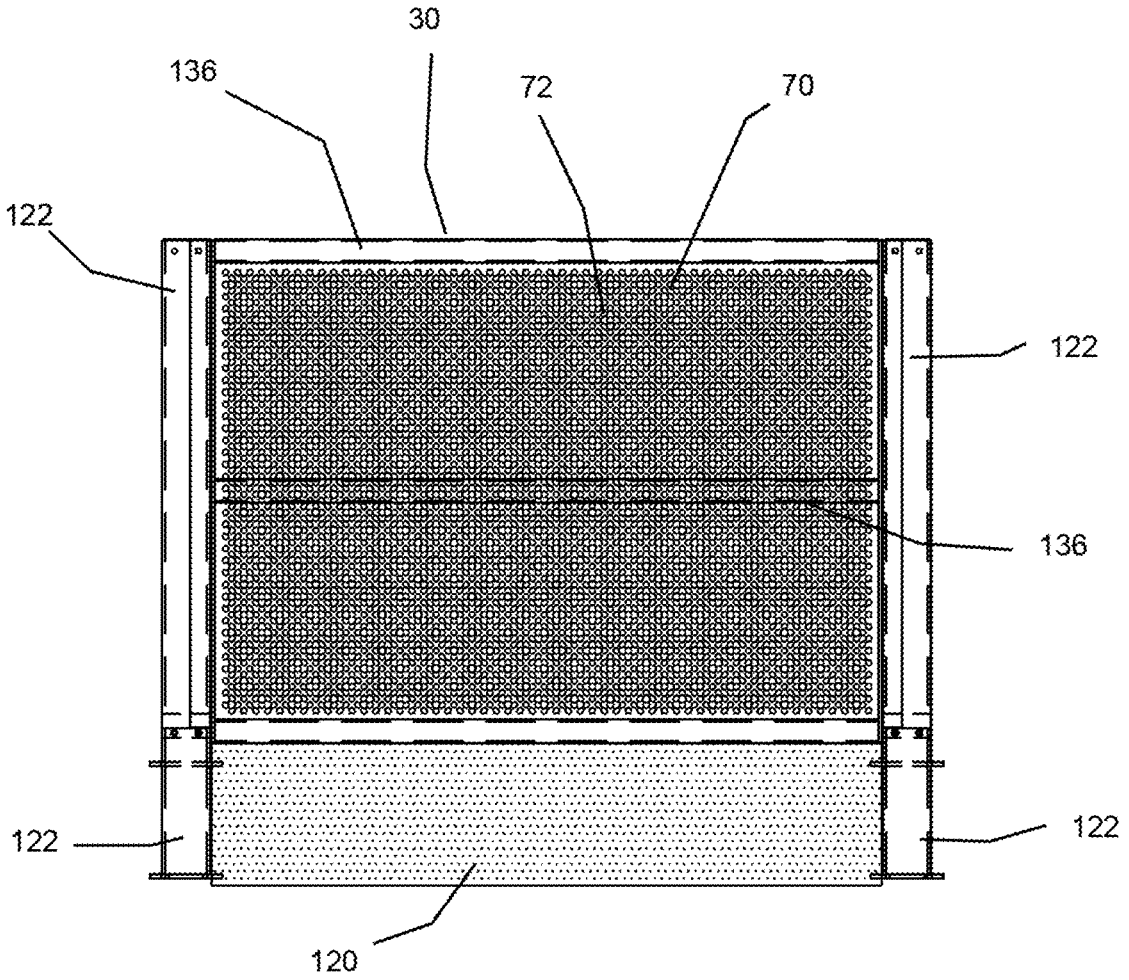
FIG. 17 is a front view of parapet panels useful with the sidewalk shed of the present invention.

FIG. 17 is a front elevational view of a portion of the parapet wall 30. The parapet wall 30 may include an upper portion 70 and a lower portion 120. The upper portions 70 and the lower portions 120 may be the same or different. As depicted in FIG. 17, the upper portion 70 and the lower portion 120 of the parapet wall 30 may be a perforated sheet(s) 72, a solid sheet(s), and combinations thereof. Parapet posts 122 are provided to support or secure the upper and lower portions 70, 120 of the parapet wall 30. Horizontal support members 136 are useful for supporting or securing longitudinal portions of the parapet wall 30. Some or all of the parapet posts 122 may be tubular members, which may have circular, rectangular, square, and the like cross-section shapes.

As depicted in, for example, FIG. 1A, any side of the canopy 32 of sidewalk shed 10 that is open to the sidewalk, i.e., not adjacently juxtaposed to a face of a building, may have the parapet wall 30 extending thereat. One side (depicted as the front side 12 in FIG. 1A) of the canopy 32 of the sidewalk shed 10 may not include a parapet wall. Such a side of the sidewalk shed not including a parapet wall may be disposed proximal to a face or portion 22 of a building 20, as shown in, for example, FIG. 5. The present invention, however, is not limited to a sidewalk shed having three sides with parapet walls. Any number of the sides, including 1, 2, 3, 4, or more sides, of the sidewalk shed 10 may include a parapet wall 30.

While various embodiments of the present invention are specifically illustrated and/or described herein, it will be appreciated that modifications and variations of the present invention may be affected by those skilled in the art without departing from the spirit and intended scope of the invention. Further, any of the embodiments or aspects of the invention as described in the claims or in the specification may be used with one and another without limitation.

What is claimed is:

1. A sidewalk shed for placement proximal to a building, comprising:

a plurality of canopy support arrangements comprising base members securable to grade;

a beam support structure securably disposed to upper portions of the plurality of the canopy support arrangements; and a canopy structure securably disposed to the beam support structure;

wherein the plurality of canopy support arrangements comprises dual leg support arrangements and single leg support arrangements;

wherein the canopy structure comprises a parapet wall and a decking; and wherein the dual leg support arrangements comprise:

a base member;

a plate;

a lower support member having a lower portion and an upper portion with a terminal end; and at least two upper support members, each having a lower portion with a terminal end and a upper portion, wherein the plate is disposed directly between the terminal end of the upper portion of the lower support member and the terminal ends of the lower portions of the at least two upper support members;

wherein the lower portion of the lower support member is securably attached to the base member;

wherein the terminal end of the upper portion of the lower support member is welded to the plate;

wherein the terminal ends of the lower portions of the at least two upper support members are welded to the plate; and wherein upper portions of the at least two upper support members are securably attached to the beam support structure.

2. The sidewalk shed of claim 1, wherein the sidewalk shed is disposed proximally to a face of the building.

3. The sidewalk shed of claim 1, wherein the beam support structure comprises cross beams disposed along a width of the sidewalk shed and longitudinal beams disposed along a length of the sidewalk shed.

4. The sidewalk shed of claim 1, the single support arrangements comprise:

a base member; and an upper support member, wherein a lower portion of the upper support member is securably attached to the base member; and wherein an upper portion of the upper support member is securably attached to the beam support structure.

5. The sidewalk shed of claim 1, the single support arrangements comprise:

a base member;

a lower support member; and an upper support member, wherein a lower portion of the lower support member is securably attached to the base member;

wherein an upper portion of the lower support member is securably attached to the upper support member; and wherein an upper portion of the upper support member is securably attached to the beam support structure.

6. The sidewalk shed of claim 1, wherein the decking is securably disposed to the beam support structure; and where the parapet wall extends upward from at least one side of the decking.

7. The sidewalk shed of claim 6, wherein the decking comprises a plurality of decking panels.

8. The sidewalk shed of claim 7, wherein the decking panels comprise a substantially transparent material.

9. The sidewalk shed of claim 7, wherein the decking panels comprise a non transparent material.

10. The sidewalk shed of claim 6, wherein the parapet wall comprises a perforated sheet.

11. A sidewalk shed for placement proximal to a building, comprising:

a plurality of canopy support arrangements comprising base members securable to grade;

a beam support structure securably disposed to upper portions of the plurality of the canopy support arrangements; and a canopy structure securably disposed to the beam support structure;

wherein the plurality of canopy support arrangements comprises dual leg support arrangements and single leg support arrangements;

wherein the canopy structure comprises a parapet wall and a decking;

wherein the dual leg support arrangements comprise:

a base member;

a lower support member having a lower portion, an upper portion and a plate securable affixed to the upper portion; and at least two upper support members, each of the at least two upper support members having a lower portion, an upper portion and a plate securably affixed to the lower portion, wherein a lower portion of the lower support member is securably attached to the base member;

wherein the plate of the upper portion of the lower support member is securably attached to the plates of the lower portions of the at least two upper support members; and wherein upper portions of the at least two upper support members are securably attached to the beam support structure.

12. The sidewalk shed of claim 11, wherein the sidewalk shed is disposed proximally to a face of the building.

13. The sidewalk shed of claim 11, wherein the beam support structure comprises cross beams disposed along a width of the sidewalk shed and longitudinal beams disposed along a length of the sidewalk shed.

14. The sidewalk shed of claim 11, the single support arrangements comprise:

a base member; and an upper support member, wherein a lower portion of the upper support member is securably attached to the base member; and wherein an upper portion of the upper support member is securably attached to the beam support structure.

15. The sidewalk shed of claim 11, the single support arrangements comprise:

a base member;

a lower support member; and an upper support member, wherein a lower portion of the lower support member is securably attached to the base member;

wherein an upper portion of the lower support member is securably attached to the upper support member; and wherein an upper portion of the upper support member is securably attached to the beam support structure.

16. The sidewalk shed of claim 11, wherein the decking is securably disposed to the beam support structure; and where the parapet wall extends upward from at least one side of the decking.

17. The sidewalk shed of claim 16, wherein the decking comprises a plurality of decking panels.

18. The sidewalk shed of claim 17, wherein the decking panels comprise a substantially transparent material.

19. The sidewalk shed of claim 17, wherein the decking panels comprise a non transparent material.

20. The sidewalk shed of claim 16, wherein the parapet wall comprises a perforated sheet.

* * * * *